US005118596A

United States Patent [19]

Matushita

[11] Patent Number: 5,118,596

[45] Date of Patent: Jun. 2, 1992

[54] SILVER HALIDE COLOR PHOTOGRAPHIC MATERIAL

[75] Inventor: Tetunori Matushita, Kanagawa, Japan

[73] Assignee: Fuji Photo Film Co., Ltd., Kanagawa, Japan

[21] Appl. No.: 489,996

[22] Filed: Mar. 7, 1990

[30] Foreign Application Priority Data

Mar. 8, 1989 [JP] Japan ..... 1-55546

[51] Int. Cl.[5] ..... G03C 7/305

[52] U.S. Cl. ..... 430/543; 430/393; 430/430; 430/955; 430/957

[58] Field of Search ..... 430/393, 430, 955, 957, 430/543

[56] References Cited

U.S. PATENT DOCUMENTS

| | | | |
|---|---|---|---|
| 4,485,169 | 11/1984 | Ishiguro et al. | 430/615 |
| 4,842,994 | 6/1989 | Sakanoue et al. | 430/543 |
| 4,847,185 | 7/1989 | Begley et al. | 430/376 |
| 4,857,440 | 8/1989 | Begley et al. | 430/382 |
| 4,865,959 | 9/1989 | Sakanoue et al. | 430/548 |
| 4,917,995 | 4/1990 | Koijima et al. | 430/565 |
| 4,970,142 | 11/1990 | Kaneko | 430/558 |

FOREIGN PATENT DOCUMENTS 335319 10/1989 European Pat. Off. .

OTHER PUBLICATIONS

Grant and Hackh's Chemical Dictionary, 5th Ed. p. 300.

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A silver halide color photographic material is disclosed, comprising a support having thereon at least one silver halide emulsion layer, which contains at least one compound represented by formula (I) in the silver halide emulsion layer or in a light-insensitive hydrophilic colloid layer: t,0010 wherein

X represents a divalent linking group connected to the carbon atom through a hetero atom in X;

Z represents a bleach accelerating agent moiety connected to X through a hetero atom in Z;

W represents =N— or (wherein Y represents a hydrogen atom or another substituent);

A represents an atomic group necessary to form an aromatic heterocyclic ring containing 3 or more hetero atoms, provided that when W represents the group adjacent to W is a group except for (wherein $R_1$, $R_2$, $R_3$, $R_4$ and $R_5$ each represents a hydrogen atom or a substituent) at the adjacent position to W; and m represents 0 to 1, provided that when m represents 0, the bleach accelerating agent moiety represented by Z is connected to the carbon atom through a hetero atom in Z.

13 Claims, No Drawings

SILVER HALIDE COLOR PHOTOGRAPHIC MATERIAL

FIELD OF THE INVENTION

The present invention relates to a silver halide color photographic material (hereinafter referred simply to as a color light-sensitive material), and more particularly, to a silver halide color photographic material containing a compound in which an active group or an adsorptive group of a bleach accelerating agent is blocked.

BACKGROUND OF THE INVENTION

The fundamental steps of processing color light-sensitive materials generally include a color developing step and a desilvering step. Thus, an exposed color light-sensitive material is introduced into a color developing step, in which silver halide is reduced with a color developing agent to produce silver and the oxidized color developing agent in turn reacts with a color former to yield a dye image. Subsequently, the color light-sensitive material is introduced into a desilvering step, in which the silver produced in the preceding step is oxidized with an oxidizing agent (usually called a bleaching agent), and dissolved away with a silver ion complexing agent (usually called a fixing agent). Therefore, only a dye image is formed in the thus processed color light-sensitive material. In addition to the above described two fundamental steps of color development and desilvering, development processing includes subsidiary steps for maintaining the photographic and physical quality of the resulting image or for improving the preservability of the image. Examples of these steps include use of a hardening bath for preventing a light-sensitive layer from being excessively softened during photographic processing, a stopping bath for effectively stopping the developing reaction, an image stabilizing bath for stabilizing the image, and a layer removing bath for removing the backing layer on the support.

The above described desilvering step may be conducted in either of two ways: a two-step method of separately employing a bleaching bath and a fixing bath; and a one-step method of employing a bleach-fixing bath containing both a bleaching agent and a fixing agent for the purpose of accelerating processing and eliminating labor.

Bleach processing using a ferric ion complex salt (for example, aminopolycarboxylic acid-ferric ion complex salt, particularly iron (III) ethylenediamine-tetraacetate complex salt) as a major bleaching agent is usually employed in processing color light-sensitive materials in view of the need to prevent environmental pollution.

However, ferric ion complex salts have a comparatively low oxidizing power and, therefore, have insufficient bleaching ability.

In order to increase the bleaching ability of a bleaching solution or a bleach-fixing solution containing a ferric ion complex salt as a bleaching agent, it has been proposed to add various bleach accelerating agents to the processing bath.

Examples of such bleach accelerating agents include 5-membered heterocyclic mercapto compounds (described in British Patent 1,138,842), thiadiazole derivatives (described in Swiss Patent 336,257), thiourea derivatives, thiazole derivatives, a 5-membered heterocyclic compound containing two or three nitrogen atoms as ring constituting members and having at least one mercapto group (described in JP-A-54-52534 (the term "JP-A" as used herein means an "unexamined published Japanese patent application")), heterocyclic alkylmercaptan derivatives (described in JP-A-53-32736), disulfide compounds (described in JP-A-53-95630), isothiourea derivatives (described in *Research Disclosure*, No. 15704 (May, 1977)), and aminoalkylmercaptan derivatives (described in U.S. Pat. No. 3,893,858). Although some of these bleach accelerating agents show a substantially satisfactory bleach accelerating effect, they have various disadvantages. More specifically, when these compounds are added to a bleaching solution and color light-sensitive materials are continuously processed using such a bleaching solution, precipitation occurs in the bleaching solution, which causes many troubles. The precipitate chokes the filters of the circulation system in an automatic processing machine and adheres to the color light-sensitive materials, resulting in stain formation. Further, the bleach accelerating effect degrades under a running condition. This phenomenon is believed to result from the fact that thiol or disulfide is converted to a thiolsulfonate ion by a sulfite ion which crosses over from a developing solution into the bleaching solution and thus loses its ability to adsorb to the developed silver.

Therefore, in order to effectively accelerate silver removal, it is desirable to incorporate such a bleach accelerating agent into the color light-sensitive material instead of adding it to a processing bath such as a bleaching bath or a bleach-fixing bath. However, many compounds which are generally designated bleach accelerating agents form undesired fog when they are directly incorporated into color light-sensitive materials. Moreover, they cause a decrease in sensitivity and a change in photographic characteristics (such as sensitivity, gradation, or fog) and are therefore impractical.

Many attempts have been made to overcome such problems as fog formation caused by the incorporation of a bleach accelerating agent into a color light-sensitive material and to increase further the bleach accelerating effect. For instance, there is a method of using a bleach accelerating agent in the form of a salt (for example, a silver salt) with a heavy metal ion as described in JP-A-53-134430, JP-A-53 147529 and JP-A-55-64237. However, this method does not provide a sufficient bleach accelerating effect. Also known are methods utilizing a bleach accelerator releasing coupler (described in *Research Disclosure*, No. 11449 (1973) and JP-A-61-201247). However, these known bleach accelerator releasing couplers release bleach accelerating agents only at the time of color development and do not release them at the time of bleaching or bleach-fixing, and thus their bleach accelerating effects are still unsatisfactory. Color light-sensitive materials containing a compound wherein an active group or an adsorptive group of a bleach accelerating agent is blocked are disclosed in JP-A-64-42650. However, these color light-sensitive materials are not sufficiently stable during processing under high temperature and high humidity conditions, although they exhibit bleach accelerating effects. Further improvement, accordingly, has been desired.

SUMMARY OF THE INVENTION

An object of the present invention is, therefore, to provide a color light-sensitive material which contains a bleach accelerating agent in a stable form, which in turn performs a sufficiently high bleach accelerating function at the time of processing.

Another object of the present invention is to provide a color light-sensitive material stably containing a blocked bleach accelerating agent which has a bleach accelerating effect which does not degrade even under a running condition.

A further object of the present invention is to provide a color light-sensitive material having a high bleaching speed and capable of undergoing rapid processing.

Other objects of the present invention will become apparent from the following description and examples.

These and other objects of the present invention are attained by a silver halide color photographic material comprising a support having thereon at least one silver halide emulsion layer, wherein the silver halide color photographic material contains at least one compound represented by formula (I) in the silver halide emulsion layer or in a light-insensitive hydrophilic colloid layer:

(I)

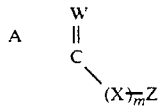

wherein

X represents a divalent linking group connected to the carbon atom through a hetero atom in X;

Z represents a bleach accelerating agent moiety connected to X through a hetero atom in Z;

W represents =N—or

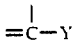

(wherein Y represents a hydrogen atom or another substituent);

A represents an atomic group necessary to form an aromatic heterocyclic ring containing 3 or more hetero atoms, provided that when W represents

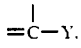

the group adjacent to W is a group except for

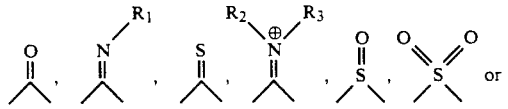

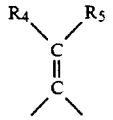

(wherein $R_1$, $R_2$, $R_3$, $R_4$ and $R_5$ each represents a hydrogen atom or a substituent) at the adjacent position to W; and m represents 0 or 1, provided that when m represents 0, the bleach accelerating agent moiety represented by Z is connected to the carbon atom through a hetero atom in Z.

DETAILED DESCRIPTION OF THE INVENTION

The compound represented by formula (I) releases the bleach accelerating agent moiety represented by Z during processing upon the addition of a nucleophilic reagent (for example, $OH^-$ ion) to the unsaturated bond present therein.

The compound represented by formula (I) is described in detail below.

Y in the formula (I) represents a hydrogen atom, a halogen atom (for example, a fluorine, chlorine, or bromine atom), an alkyl group (preferably having from 1 to 20 carbon atoms), an alkenyl group (preferably having from 2 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an acyloxy group (preferably having from 2 to 20 carbon atoms), an amino group (including an unsubstituted amino group and preferably a secondary or a tertiary amino group substituted with an alkyl group having from 1 to 20 carbon atoms or with an aryl group having from 6 to 20 carbon atoms), a carbonamide group (preferably an alkylcarbonamido group having from 1 to 20 carbon atoms or an arylcarbonamido group having from 6 to 20 carbon atoms), a ureido group (preferably an alkylureido group having from 1 to 20 carbon atoms or an arylureido group having from 6 to 20 carbon atoms), a carboxy group, a carbonic acid ester group (preferably an alkyl carbonic acid ester having from 1 to 20 carbon atoms or an aryl carbonic acid ester having from 6 to 20 carbon atoms), an oxycarbonyl group (preferably an alkyloxycarbonyl group having from 1 to 20 carbon atoms or an aryloxycarbonyl group having from 6 to 20 carbon atoms), a carbamoyl group (preferably an alkylcarbamoyl group having from 1 to 20 carbon atoms or an arylcarbamoyl group having from 6 to 20 carbon atoms), an acyl group (preferably an alkylcarbonyl group having from 1 to 20 carbon atoms or an arylcarbonyl group having from 6 to 20 carbon atoms), a sulfo group, a sulfonyl group (preferably an alkylsulfonyl group having from 1 to 20 carbon atoms or an arylsulfonyl group having from 6 to 20 carbon atoms), a sulfamoyl group (preferably an alkylsulfamoyl group having from 1 to 20 carbon atoms or an arylsulfamoyl group having from 6 to 20 carbon atoms), a cyano group or a nitro group. The alkyl group, alkenyl group or aryl group described above may be further substituted with one or more substituents selected from the above described substituents.

The ring formed by A in the formula (I) is an aromatic heterocyclic ring containing 3 or more hetero atoms. The aromatic heterocyclic ring may form a condensed ring at an appropriate position. The term "an aromatic heterocyclic ring containing 3 or more hetero atoms" as used herein means that when the aromatic heterocyclic ring forms the condensed ring, the total number of hetero atoms including hetero atoms contained in the condensed ring portion is 3 or more, and preferably the number of hetero atoms except for hetero atoms contained in the condensed ring portion is 3 or more. The preferred hetero atoms are an oxygen atom, a nitrogen atom and a sulfur atom. However, when W represents $$=\overset{|}{C}-Y,$$

the heterocyclic ring which is substituted by

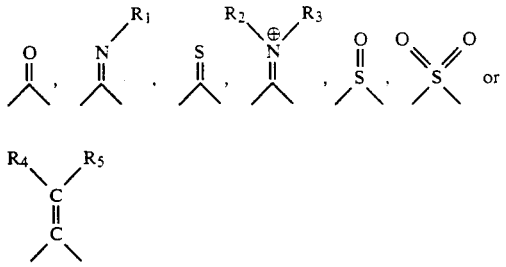

(wherein $R_1$, $R_2$, $R_3$, $R_4$ and $R_5$ each represents a hydrogen atom or a substituent) at the adjacent position to the W group is excluded.

Specific examples of the aromatic heterocyclic ring include triazole, tetrazole and triazine, and those heterocyclic rings having a condensed ring at an appropriate position, for example, triazolo[4,5-d]-pyrimidine, 4H-pyrido[1,2-a]pyrimidine, a triazaindene (for example, imidazo[1,5-a]pyrimidine, pyrazolo[1,5-a]pyrimidine, 1H-imidazo[4,5-b]pyridine, or 7-H-pyrrolo[2,3-d]pyrimidine), a tetraazaindene (for example, 1H-1,2,4-triazolo[4,3b]pyridazine, 1,2,4-triazolo[1,5-a]pyrimidine, imidazo[1,2-a]-1,3,5-triazine, pyrazolo[1,5-a]-1,3,5-triazine, 7H-purine, 9H-purine, or 1H-pyrazolo[3,4-d]-pyrimidine), and a pentaazaindene (for example, 1,2,4-triazolo[1,5-a]-1,3,5-triazine, 1,2,4-triazolo[3,4-f]1,2,4-triazine, or 1H-1,2,3-triazolo[4,5-d]pyrimidine).

The heterocyclic ring may have one or more substituents described below. When two or more substituents are present, they may be the same or different. Specific examples of the substituents include a halogen atom (for example, a fluorine, chlorine, or bromine atom), an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyl group (preferably having from 2 to 20 carbon atoms), an acylamino group (preferably an alkanoylamino group having from 1 to 20 carbon atoms or a benzoylamino group having from 6 to 20 carbon atoms), a nitro group, a cyano group, an oxycarbonyl group (preferably an alkoxycarbonyl group having from 1 to 20 carbon atoms or an aryloxycarbonyl group having from 6 to 20 carbon atoms), a hydroxy group, a carboxy group, a sulfo group, a ureido group (preferably an alkylureido group having from 1 to 20 carbon atoms or an arylureido group having from 6 to 20 carbon atoms), a sulfonamide group (preferably an alkylsulfonamide group having from 1 to 20 carbon atoms or an arylsulfonamide group having from 6 to 20 carbon atoms), a sulfamoyl group (preferably an alkylsulfamoyl group having from 1 to 20 carbon atoms or an arylsulfamoyl group having from 6 to 20 carbon atoms), a carbamoyl group (preferably an alkylcarbamoyl group having from 1 to 20 carbon atoms or an arylcarbamoyl group having from 6 to 20 carbon atoms), an acyloxy group (preferably having from 1 to 20 carbon atoms), an amino group (including an unsubstituted amino group and preferably a secondary or a tertiary amino group substituted with an alkyl group having from 1 to 20 carbon atoms or with an aryl group having from 6 to 20 carbon atoms), a carbonic acid ester group (preferably an alkyl carbonic acid ester having from 1 to 20 carbon atoms or an aryl carbonic acid ester having from 6 to 20 carbon atoms), a sulfone group (preferably an alkylsulfone group having from 1 to 20 carbon atoms or an arylsulfone group having from 6 to 20 carbon atoms), or a sulfinyl group (preferably an alkylsulfinyl group having from 1 to 20 carbon atoms or an arylsulfinyl group having from 6 to 20 carbon atoms).

Of the heterocyclic rings formed by A, nitrogen-containing aromatic heterocyclic rings are preferred. Particularly, aromatic heterocyclic rings containing three or more nitrogen atoms are more preferred, and a triazaindene, a tetraazaindene and a pentaazaindene are most preferred.

Examples of the bleach accelerating agent moiety represented by Z in the formula (I) include various mercapto compounds (described in U.S. Pat. No. 3,893,858, British Patent 1,138,842, and JP-A-53-141623); compounds having a disulfide bond (described in JP-A-53-95630); thiazolidine derivatives (described in JP-B-53-9854 (the term "JP-B" as used herein means an "examined Japanese patent publication")); isothiourea derivatives (described in JP-A-53-94927); thiourea derivatives (described in JP-B-45-8506 and JP-B-49-26586); thioamide compounds (described in JP-A-49-42349); dithiocarbamates (described in JP-A-55-26506); and arylenediamine compounds (described in U.S. Pat. No. 4,552,834).

The bleach accelerating agent moiety is connected to X (when m is 1) or the carbon atom (when m is 0) through a hetero atom in the Z group, which is capable of being substituted.

The group represented by Z is more preferably represented by the following formula (Z-1), (Z-2), (Z-3), (Z-4) or (Z-5):

$$-S-L_1-(X_1)_a \qquad (Z-1)$$

wherein a represents an integer of from 1 to 4; $L_1$ represents a straight chain or branched chain alkylene group having a valency of (a+1) and having from 1 to 8 carbon atoms (for example, methylene, ethylene, trimethylene, ethylidene, isopropylidene, propylene, or 1,2,3-propanetriyl), not including a cycloalkylene; and $X_1$ represents a hydroxy group, a carboxyl group, a cyano group, an amino group having from 0 to 10 carbon atoms (for example, amino, methylamino, ethylamino, dimethylamino, diethylamino, diisopropylamino, pyrrolidino, piperidino, morpholino, or hydroxyamino), an acyl group having from 1 to 10 carbon atoms (for example, formyl, or acetyl), a heterocyclic thio group having from 1 to 10 carbon atoms (for example, 4-pyridylthio, or imidazolylthio), a carbamoyl group having from 1 to 10 carbon atoms (for example, carbamoyl, dimethylcarbamoyl, hydroxycarbamoyl, or morpholinocarbonyl), a sulfonyl group having 1 to 10 carbon atoms (for example, methylsulfonyl, or ethylsulfonyl), a heterocyclic group having from 1 to 10 carbon atoms (for example, pyridyl, or imidazolyl), a sulfamoyl group having from 0 to 10 carbon atoms (for example, sulfamoyl, methylsulfamoyl, dimethylsulfamoyl, or pyrrolidinosulfonyl), a carbonamido group having from 1 to 10 carbon atoms (for example, formamido, or acetamido), an ammoniumyl group having from 3 to 12 carbon atoms (for example, trimethylammoniumyl, or pyridiniumyl), a ureido group having from 1 to 10 carbon atoms (for example, ureido, or 3-methylureido), a sulfamoylamino group having from 0 to 10 carbon atoms (for example, sulfamoylamino, or 3,3-dimethylsulfamoylamino), an alkoxy group having from 1 to 6 carbon atoms (for example, methoxy), an amidino group, a guanidino group, or an amidinothio group, provided that when a is greater than 1, the X, groups may be the same or different;

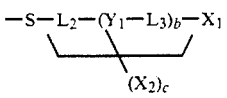

(Z-2)

wherein b represents an integer of from 1 to 6; c represents an integer of from 0 to 7; $L_2$ and $L_3$ each represents a straight chain or branched chain alkylene group having from 1 to 3 carbon atoms; $X_1$ and $X_2$ each has the same meaning as X: defined in the formula (Z-1); and $Y_1$ represents

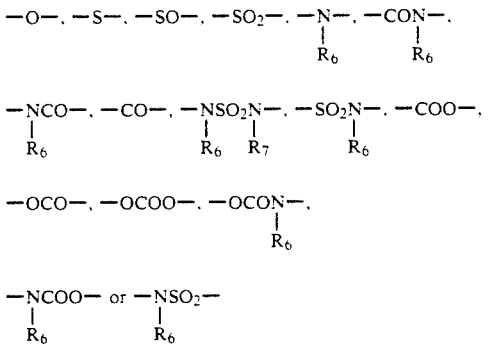

wherein $R_6$ and $R_7$ each represents a hydrogen atom or an alkyl group having from 1 to 10 carbon atoms (for example, methyl, ethyl, hydroxymethyl, hydroxyethyl, methoxyethyl, carboxymethyl, carboxyethyl, or propyl), provided that when b is greater than 1, the $Y_1$—$L_3$ groups may be the same or different, with proviso that all $Y_1$ groups are not —S— at the same time, and when c is an integer other than 0, $X_2$ may be substituted on any of the $L_2$, $Y_1$ and $L_3$ groups;

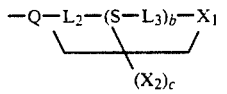

(Z-3)

wherein b, c, $L_2$, $L_3$, $X_1$ and $X_2$ each has the same meaning as in the formula (Z-2); and Q represents —O—, —S—, —OCO—, —OSO—, —OSO—,

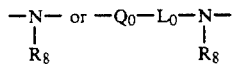

(wherein $R_8$ has the same meaning as $R_6$ defined in the formula (Z-2); $L_0$ has the same meaning as $L_2$ defined above; and $Q_0$ represents —O—, —OCO—, —$OSO_2$—, —OSO—or

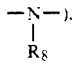

provided that when b is greater than 1, the S-$L_3$ groups may be the same or different, and when c is an integer other than 0, $X_2$ may be substituted on any of the Q, $L_2$ and $L_3$ groups, with the further proviso that when Q is —S—, b is not 1;

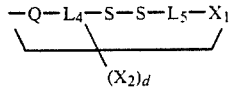

(Z-4)

wherein Q, $X_1$ and $X_2$ each has the same meaning as in the formula (Z-3); d represents an integer of from 0 to 6; and $L_4$ and $L_5$ each represents a linking group having from 1 to 16 carbon atoms in total (for example, an alkylene or alkylenes which are bonded via —O—, —S—or

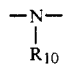

(wherein $R_{10}$ has the same meaning as $R_6$ defined in the formula (Z-2)), provided that when d is an integer other than 0, $X_2$ may be substituted on any of the Q, $L_4$ and $L_5$ groups; and

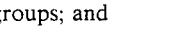

(Z-5)

wherein $L_6$ represents a cycloalkylene group having from 3 to 12 carbon atoms (for example, a group derived from cyclopropane, cyclobutane, cyclopentane, methylcyclopentane, cyclohexane, cyclopentanone, cyclohexanone, or biscyclo[2,2,1]pentane), an arylene group having from 6 to 10 carbon atoms (for example, phenylene, or naphthylene), an unsaturated heterocyclic group having from 1 to 10 carbon atoms (for example, a group derived from pyrrole, pyrazole, imidazole, 1,3,5 triazole, 1,2,4-triazole, tetrazole, oxazole, thiazole, indole, indazole, benzimidazole, benzoxazole, benzothiazole, 1,3,4-oxadiazole, 1,3,4-thiadiazole, purine, tetraazaindene, isooxazole, isothiazole, pyridine, pyrimidine, pyridazine, 1,3,5-triazine, quinoline, furan, or thiophene), or a saturated (or partially saturated) heterocyclic group having from 2 to 10 carbon atoms (for example, a group derived from oxirane, thirane, azinidine, oxetane, oxolane, thiolane, thietane, oxane, thiane, dithiane, dioxane, piperidine, morpholine, piperazine, imidazolidine, pyrrolidine, pyrazoline, pyrazolidine, imidazolidine, pyran, thiopyran, oxazoline, or sulforane); $X_3$ represents a hydrophilic substituent, preferably a hydrophilic substituent having a $\pi$ substituent constant of not more than 0.5, and more preferably a hydrophilic substituent having a $\pi$ substituent constant of a negative value; and e represents an integer of from 0 to 5, preferably from 1 to 3.

The $\pi$ substituent constant of the substituent represented by $X_3$ is determined by the method described in C. Hansch and A. Leo, *Substituent Constants for Correlation Analysis in Chemistry and Biology*, John Wiley (1979).

Specific examples of the hydrophilic substituents represented by $X_3$ are set forth below, wherein the $\pi$ substituent constant of the substituent is indicated in parentheses:

$-CONH_2$ (−1.49), $-CO_2H$ (−0.32)
$-COCH_3$ (−0.55), $-NHCOCH_3$ (−0.97),
$-CH_2CH_2CO_2H$ (−0.29), $-CH_2CH_2NH_2$ (−0.08), $-SCH_2CO_2H$ (−0.31), $-SCH_2CH_2N(CH_3)_2$ (−0.43), $-CH_2CO_2H$ (−0.72), $-SCH_2CONH_2$ (−0.97), $-SCH_2C(=O)-CH_3$ (−0.43), $-SCH_2CH_2CO_2H$ (−0.01), $-OH$ (−0.67), $-CONHOH$ (−0.38),
$-CH_2OH$ (−1.03), $-CN$ (−0.57),
$-CH_2CN$ (−0.57), $-CH_2NH_2$ (−1.04), $-CH_2N(CH_3)_2$ (−0.15), $-NH_2$ (−1.23), $-NHCHO$ (−0.98), $-NHCONH_2$ (−1.30),
$-NHCH_3$ (−0.47), $-NHSO_2CH_3$ (−1.18), $-N(CH_3)_2$ (0.18) $-SO_3^{\ominus}$ (−4.76), $-N(SO_2CH_3)_2$ (−1.51), $-OCONH_2$ (−1.05),
$-OCH_3$ (−0.02), $-OSO_2CH_3$ (−0.88),
$-OCOCH_3$ (−0.64), $-OCH_2COOH$ (−0.87),
$-SO_2NH_2$ (−1.82), $-SO_2CH_3$ (−1.63),
$-SO_2N(CH_3)_2$ (−0.78), $-OCH_2CONH_2$ (−1.37), $-OCH_2CON(CH_3)_2$ (−1.36),

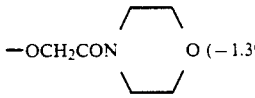
(−1.39),

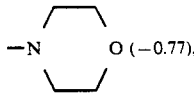
(−0.77), $-P(=O)(OCH_3)_2$ (−1.18), $-N^{\oplus}(CH_3)_3$ (−5.96), $-C(=O)NHOH$ (−1.87).

Specific examples of the group represented by formula (Z-1) are set forth below:

$-SCH_2CH_2CO_2H$, $-SCH_2CO_2H$, $-SCH_2CH_2N(CH_3)_2$, $-SCH_2CH(OH)CH_2OH$, $-SCH_2CH_2NH_2$, $-SCH_2CH(NH_2)CO_2H$,

-continued

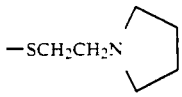
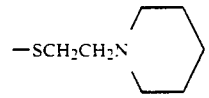

$-SCH_2CH_2CH(NH_2)COOH$, 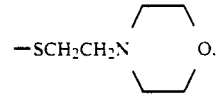

$-SCH_2CH_2NHCH_3$, $-SCH_2CH_2NHSO_2CH_3$, $-SCH_2CH_2NHCOOCH_3$, $-SCH_2CH_2P(=O)(ONa)_2$, $-SCH_2CH_2OP(=O)(ONa)_2$, $-SCH_2CH_2OH$,
$-SCH_2CH_2SO_2CH_3$, $-SCH_2CH_2CH_2SO_3Na$, $-SCH_2CH_2SO_2NH_2$, $-SCH_2CH_2N(C_2H_5)_2$ $-S(CH_2)_3COOH$, $-SCH(CH_3)COOH$, $-SCH_2CH(CH_3)COOH$, $-SCH_2CH_2SO_3K$, $-S(CH_2)_3N(CH_3)_2$, $-SCH_2CH_2S-C(=NH)NH_2$, $-SCH_2CH_2CH_2OH$, and $-SCH_2CH_2N(C_3H_7(i))_2$.

Specific examples of the group represented by formula (Z-2) are set forth below:

$-SCH_2CH_2SCH_2CH_2OH$, $-SCH_2CH_2SCH_2COOH$,
$-SCH_2CH_2SCH_2CH_2COOH$, $-SCH_2CH_2SCH_2CH_2N(CH_3)_2$, $-SCH_2CH_2OCH_2CH_2OH$,
$-SCH_2CH_2(OCH_2CH_2)_2OH$, $-SCH_2CH_2(OCH_2CH_2)_3OH$, $-SCH_2CH_2C(=O)CH_2OH$, $-SCH_2CONHCH_2COOH$, $-S(CH_2CH_2O)_3CH_2COOH$,
$-SCH_2CH_2N(CH_2COOH)_2$, and
$-SCH_2CH_2SO_2CH_2COOH$.

Specific examples of the group represented by formula (Z-3) are set forth below:

$-OCH_2CH_2SCH_2CH_2N(CH_3)_2$,

-continued
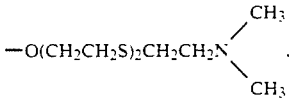
$-NH(CH_2CH_2S)_3CH_2CH_2OH$.
$-S(CH_2CH_2S)_2CH_2CH_2OH$.
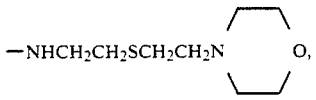
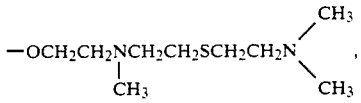
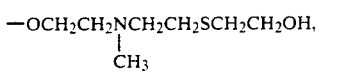
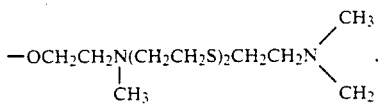
$-NH(CH_2CH_2S)_3CH_2CH_2NH_2$, and
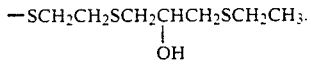
Specific examples of the group represented by formula (Z-4) are set forth below:
$-OCH_2CH_2SSCH_2CH_2OH$.
$-NHCH_2CH_2SSCH_2CH_2NH_2$.
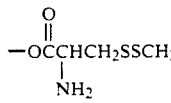
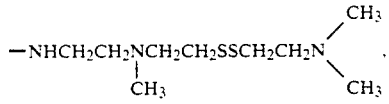
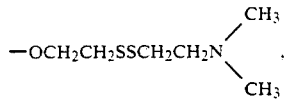
$-OCH_2CH_2SSCH_2CH_2COOH$,
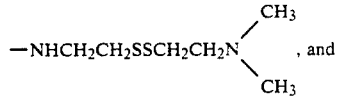
, and
$-SCH_2CH_2SSCH_2CH_2OH$.
Specific examples of the group represented by formula (Z-5) are set forth below:
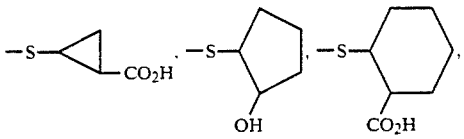
-continued
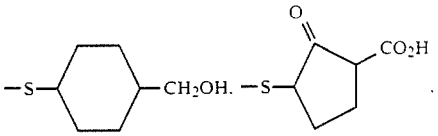
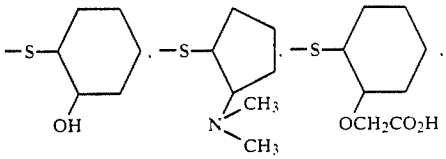
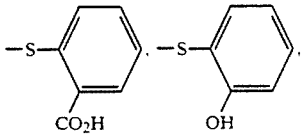
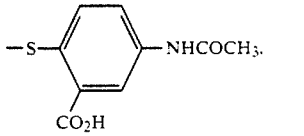
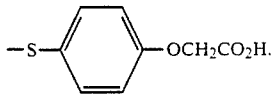
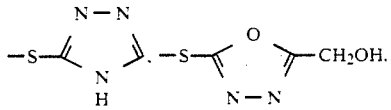
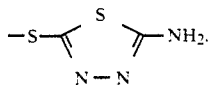
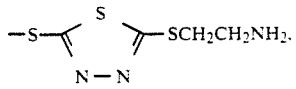
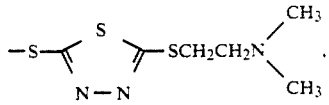
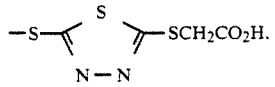
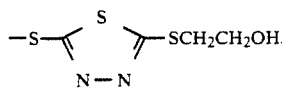
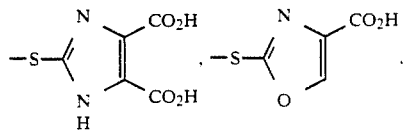

-continued

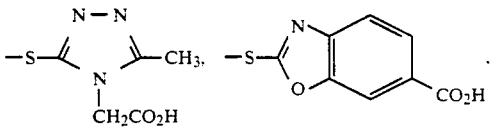

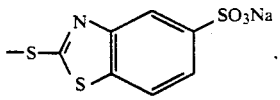

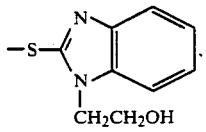

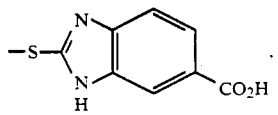

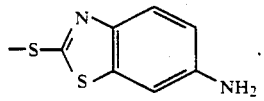

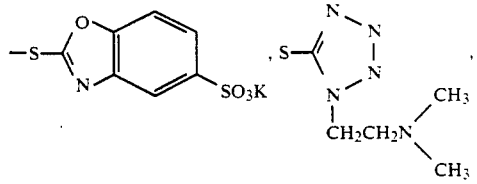

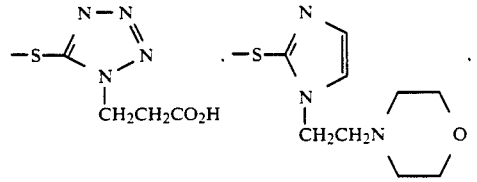

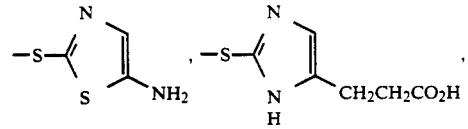

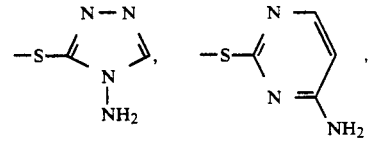

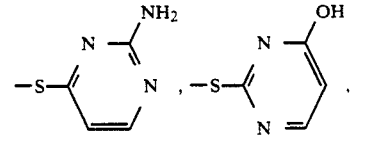

-continued

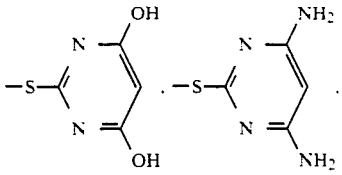

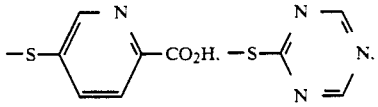

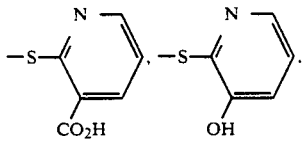

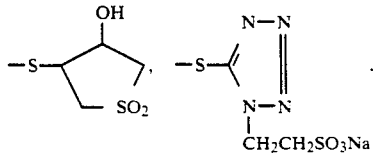

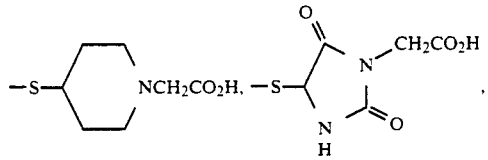

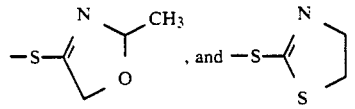

Of the groups represented by formula (Z-5), those wherein $L_6$ represents a heterocyclic group are preferred.

Among the bleach accelerating agent moieties represented by Z, the groups represented by formulae (Z-1), (Z-4) and (Z-5) are preferred, and those represented by formula (Z-1) are more preferred.

The above described bleach accelerating agent moiety may be connected directly (when m is 0) to the carbon atom, or may be connected via X (when m is 1) to the carbon atom, through a hetero atom in the agent.

The group represented by X in the formula (I) is a divalent linking group which is connected to the carbon atom through a hetero atom in the X group. The X group promptly releases Z after the X-Z bond is cleaved from the compound represented by formula (I) at the time of processing.

Specific examples of this type of linking group include those which release Z upon an intramolecular ring closing reaction as described, for example, in JP-A-54-145135 (British Patent Application (OPI) No. 2,010,818A), those which release Z upon an intramolecular electron transfer as described, for example, in British Patent 2,072,363 and JP-A-57-154234, those which release Z with the elimination of carbon dioxide as described, for example, in JP-A-57-179842, and those which , release Z with the elimination of formaldehyde as described, for example, in JP-A-59-93422. Structural formulae of typical examples of X described above are set forth below together with Z;

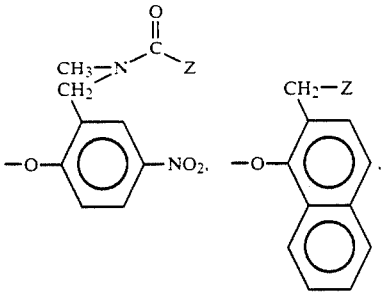

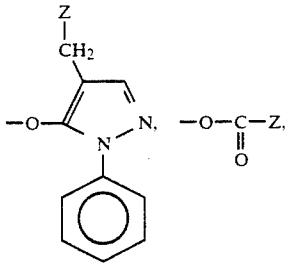

$-OCH_2-Z$, $-O-\underset{\underset{O}{\|}}{C}-OCH_2-Z$,

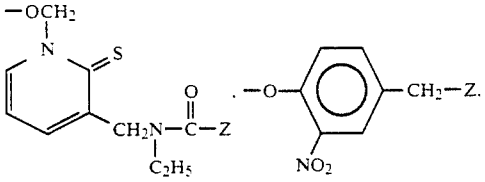

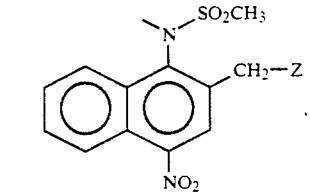

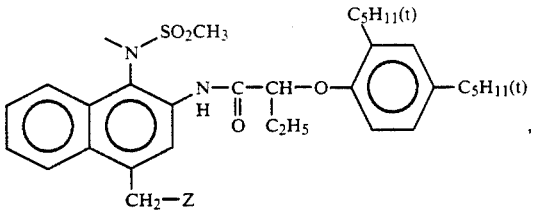

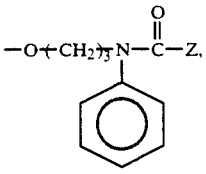

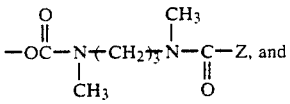

-continued

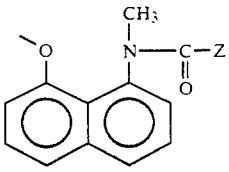

The group represented by X are selected depending on the timing for releasing the Z group, control on releasing the Z, the kind of Z group to be used, or other factors.

Specific esamples of the compound represented by the general formula (I) according to the present invention are set forth below, but the present invention should not be construed as being limited thereto:

(I-1)

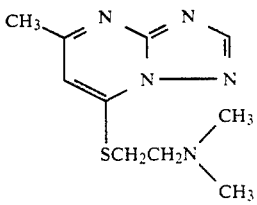

(I-2)

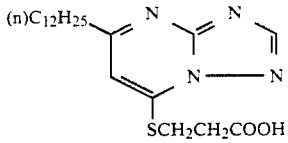

(I-3)

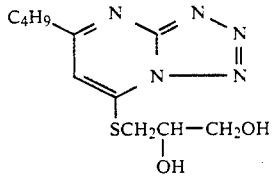

(I-4)

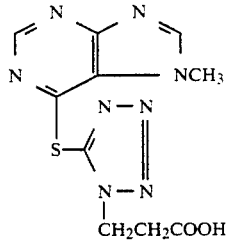

(I-5)

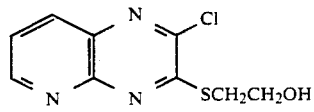

(I-6)

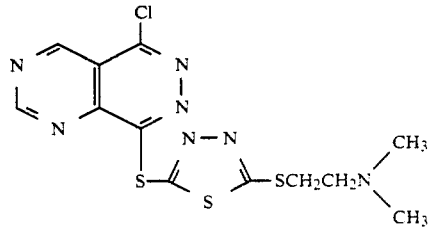

-continued
(I-7)
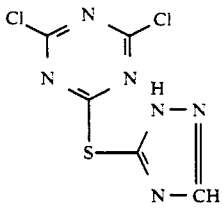
(I-8)
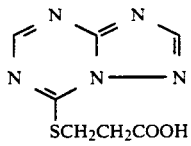
(I-9)
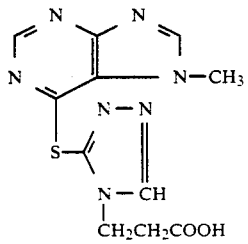
(I-10)
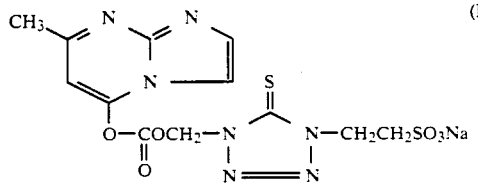
(I-11)
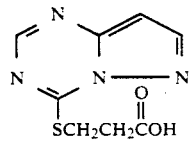
(I-12)
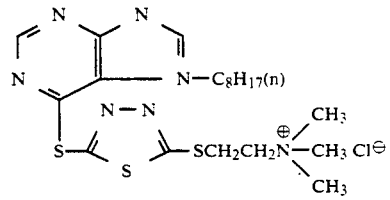
(I-13)
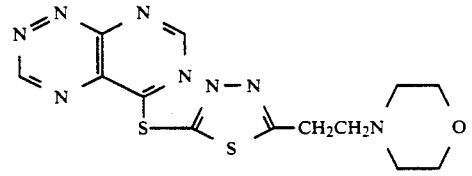
(I-14)
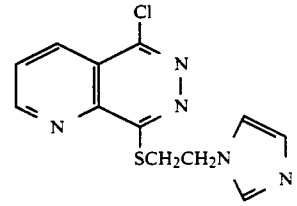
-continued
(I-15)
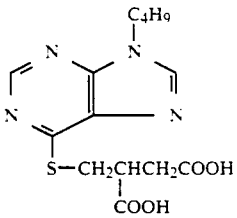
(I-16)
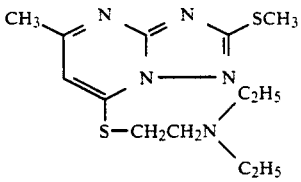
(I-17)
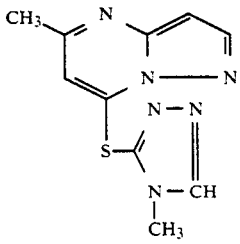
(I-18)
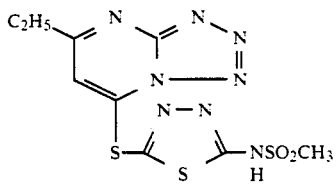
(I-19)
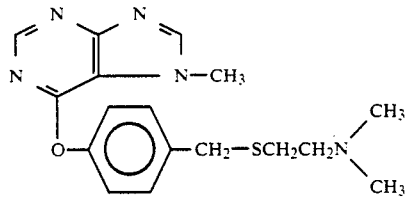
(I-20)
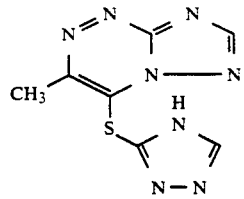
(I-21)
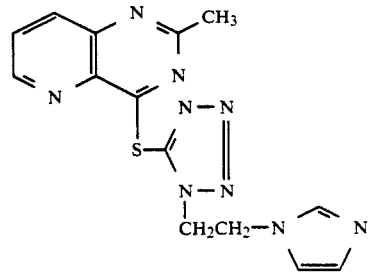

-continued (I-22)

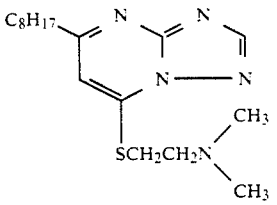

(I-23)

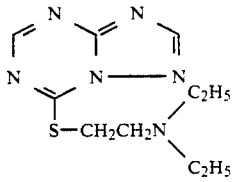

(I-24)

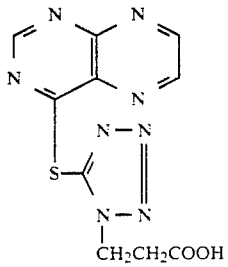

(I-25)

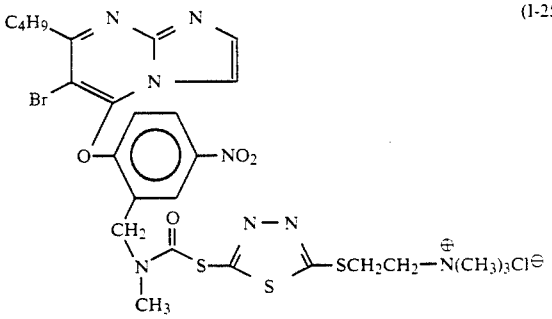

(I-26)

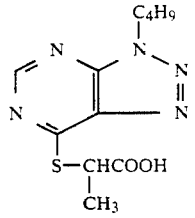

(I-27)

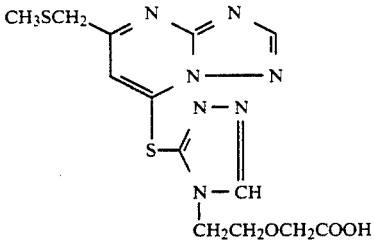

(I-28)

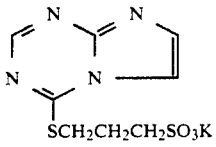

-continued (I-29)

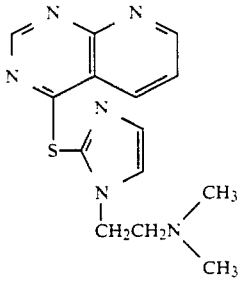

(I-30)

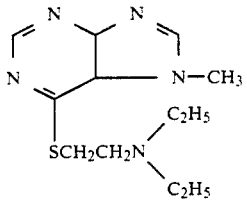

(I-31)

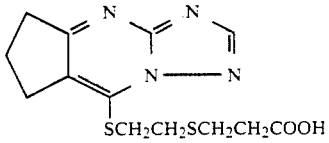

(I-32)

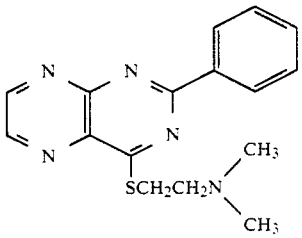

(I-33)

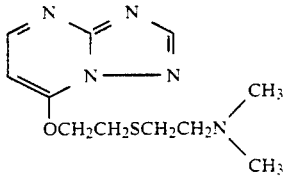

(I-34)

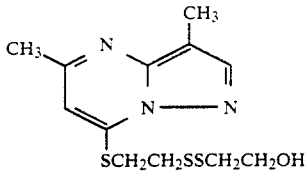

The compounds represented by formula (I) according to the present invention can be synthesized by methods, for example, those described in JP-A-1-245255 corresponding to European Patent Application No. 335,319$A_2$.

Specific examples of the synthesis of the compound are illustrated below.

SYNTHESIS EXAMPLE 1

Synthesis of Compound (I-1)

To 20 ml of a methanol solution containing 5 g of dimethylaminoethanethiol hydrochloride dissolved therein was added 14.3 g of sodium methylate (28 wt%). The mixture was stirred for 5 minutes and 20 ml of a methanol solution containing 6 g of 5-chloro-7-methyl-1,2,4-triazolo[1,5-a]pyrimidine was added dropwise thereto. After stirring at room temperature for 3 hours, the reaction solution was filtered, and the filtrate was concentrated. The crude crystals thus obtained were recrystallized from a solvent mixture of chloroform and methanol, whereby 8.1 g of the desired Compound (I-1) was obtained in the form of white crystals.

SYNTHESIS EXAMPLE 2

Synthesis of Compound (I-8)

To 20 ml of an acetonitrile solution containing 4 g of 5-mercapto-1,2,4-triazolo[1,5-a]-1,3,5-triazine dissolved therein was added 8 ml of triethylamine. The mixture was stirred for 5 minutes and 15 ml of an acetonitrile solution containing 2.9 g of 3-chloropropionic acid dissolved therein was added dropwise thereto. The mixture was heated to a temperature between 40° C. and 50° C. and stirred for 5 hours. After being allowed to cool, the reaction solution was concentrated under a reduced pressure. The residue thus obtained was dissolved in chloroform, the pH of the solution was acidified (below pH 2) by adding hydrochloric acid, and extraction was performed. The organic layer was dried with anhydrous magnesium sulfate and concentrated. The resulting residue was purified by silica gel column chromatography, whereby 4.3 g of Compound (I-8) was obtained in the form of light yellow crystals.

The compound represented by formula (I) according to the present invention can be added to any layer including a light-sensitive emulsion layer and a light-insensitive hydrophilic colloid layer. It may be added, for example, to a red-sensitive layer, a green-sensitive layer, a blue-sensitive layer, an antihalation layer, a yellow filter layer, or an intermediate layer. It is preferred to incorporate it into a light-insensitive layer.

The amount of the compound represented by formula (I) according to the present invention to be added is usually from 0.01 mol% to 100 mol%, preferably from 0.1 mol% to 50 mol%, particularly preferably from 1 mol% to 20 mol%, based on the total coating amount of silver.

The compound according to the present invention can be dissolved or dispersed using, for example, an alcohol such methanol, water, tetrahydrofuran, acetone, gelatin, or a surface active agent, and then added to a coating solution. Also, the compound can be dissolved in an organic solvent having a high boiling point, and then emulsified and dispersed using a homogenizer in a manner similar to the incorporation of coupler described hereinafter.

In the photographic emulsion layer of the photographic light-sensitive material used in the present invention, silver bromide, silver iodobromide, silver chlorobromide, silver chloroiodobromide, silver chloride or silver chloroiodide may be employed as the silver halide. A preferable silver halide is silver iodobromide, silver iodochloride or silver iodochlorobromide, each containing about 30 mol% or less of silver iodide. Silver iodobromide containing from about 2 mol% to about 25 mol% of silver iodide is particularly preferred.

Silver halide grains in the silver halide emulsion may have a regular crystal structure (for example, a cubic, octahedral or tetradecahedral structure), an irregular crystal structure (for example, a spherical or tabular structure), a crystal defect (for example, a twin plane), or a composite structure thereof.

The particle size of the silver halide may be varied and includes fine grains having a diameter of projected area of about 0.2 micron or less to large size grains having about 10 microns. Further, a polydispersed emulsion and a monodispersed emulsion may be used.

The silver halide photographic emulsion which can be used in the present invention can be prepared using known methods, for example, those as described in *Research Disclosure*, No. 17643 (December, 1978), pages 22 to 23, "I. Emulsion Preparation and Types" and ibid., No. 18716 (November, 1979), page 648.

Monodispersed emulsions described, for example, in U.S. Pat. Nos. 3,574,628 and 3,655,394, and British Patent 1,413,748, are preferably used in the present invention.

Further, tabular silver halide grains having an aspect ratio of about 5 or more can be employed in the present invention. The tabular grains may be easily prepared by the method described, for example, in Gutoff, *Photographic Science and Engineering*, Vol. 14, pages 248 to 257 (1970), U.S. Pat. Nos. 4,434,226, 4,414,310, 4,433,048 and 4,439,520, and British Patent 2,112,157.

Crystal structure of silver halide grains may be uniform, comprise different halide compositions between the inner portion and the outer portion, or have a stratified structure.

Silver halide emulsions in which silver halide grains having different compositions are connected upon epitaxial junctions or silver halide emulsions in which silver halide grains are connected with compounds other than silver halide, such as silver thiocyanate, or lead oxide may also be employed.

Moreover, a mixture of grains having a different crystal structure may be used.

The silver halide emulsions used in the present invention are usually subjected to physical ripening, chemical ripening and spectral sensitization. The kinds of additives which can be employed in these steps are described in *Research Disclosure*, No. 17643, (December, 1978) and ibid., No. 18716 (November, 1979) are listed in the table shown below.

Further, known photographic additives which can be used in the present invention are also described in the above mentioned literature references and are listed in the table below.

| Kind of Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers and Supersensitizers | Pages 23 to 24 | Page 648, right column to page 649, right column |
| 4. Brightening Agents | Page 24 | — |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | — |
| 9. Hardeners | Page 26 | Page 651, left column |
| 10. Binders | Page 26 | Page 651,- left column |
| 11. Plasticizers and Lubricants | Page 27 | Page 650, right column |
| 12. Coating Aids and | Pages 26 | Page 650, |

-continued

| Kind of Additives | RD 17643 | RD 18716 |
|---|---|---|
| Surfactants | to 27 | right column |
| 13. Antistatic Agents | Page 27 | Page 650, right column |

To prevent degradation of photographic properties due to formaldehyde gas, it is preferred to add a compound capable of reacting with formaldehyde to fix it (described in U.S. Pat. Nos. 4,411,987 and 4,435,503) to the photographic light-sensitive material.

In the present invention, various color couplers can be employed and specific examples thereof are described in the patents cited in *Research Disclosure*, No. 17643, "VII-C" to "VII-G".

Yellow couplers used in the present invention include those described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A, those in latter document being preferred.

As magenta couplers used in the present invention, 5 pyrazolone type and pyrazoloazole type compounds are preferred. Magenta couplers described, for example, in U.S. Pat. Nos. 4,310,619 and 4,351,897, European Patent 73,636, U.S. Pat. Nos. 3,061,432 and 3,725,064, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, and U.S. Pat. Nos. 4,500,630, 4,540,654 and 4,556,630, and WO(PCT) 88/04795 are particularly preferred.

Preferred as the cyan couplers used in the present invention are phenol type and naphthol type couplers described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patents 121,365A and 249,453A, U.S. Pat. Nos. 3,446,622, 4,333,999, 4,753,871, 4,451,559, 4,427,767, 4,690,889, 4,254,212 and 4,296,199, and JP-A-61-42658.

Preferably employed as the colored couplers for correcting undesirable absorptions of dyes formed, are those described in *Research Disclosure*, No. 17643, "VII-G", U.S. Pat. No. 4,163,670, JP-B-57-39413, U.S. Pat. Nos. 4,004,929 and 4,138,258, and British Patent 1,146,368.

Preferably employed as the couplers capable of forming appropriately diffusible dyes, are those as described, for example, in U.S. Pat. No. 4,366,237, British Patent 2,125,570, European Patent 96,570, and West German Patent Application (OLS) No. 3,234,533.

Typical examples of the polymerized dye forming couplers are described, for example, in U.S. Pat. Nos. 3,451,820, 4,080,211, 4,367,282, 4,409,320 and 4,576,910, and British Patent 2,102,173.

Couplers capable of releasing a photographically useful moiety during the course of coupling can be also employed preferably in the present invention. Preferred DIR couplers capable of releasing a development inhibitor are described, for example, in the patents cited in *Research Disclosure*, No. 17643, "VII-F" described above, JP-A-57-151944, JP-A-57-154234, JP-A-60-184248, JP-A-63-37346, and U.S. Pat. No. 4,248,962.

Preferred couplers which release imagewise a nucleating agent or a development accelerator at the time of development are those described, for example, in British Patents 2,097,140 and 2,131,188, JP-A-59-157638, and JP-A-59-170840.

The following compounds may be employed in the light-sensitive material of the present invention: competing couplers such as those described, for example, in U.S. Pat. No. 4,130,427; polyequivalent couplers such as those described, for example, in U.S. Pat. Nos. 4,283,472, 4,338,393 and 4,310,618; DIR redox compound or DIR coupler releasing couplers or DIR coupler or DIR redox compound releasing redox compound such as those described, for example, in JP-A-60-185950 and JP-A-62-24252; couplers capable of releasing a dye which turns to a colored form after being released such as those described, for example, in European Patent 173,302A; bleach accelerator releasing couplers such as those described, for example, in *Research Disclosure*, No. 11449, ibid, No. 24241 and JP-A-61-201247; ligand releasing couplers such as those described, for example, in U.S. Pat. No. 4,553,477; and couplers capable of releasing a leuco dye such as those described, for example, in JP-A-63-75747.

The couplers which can be used in the present invention are introduced into the photographic light-sensitive material according to various known dispersing methods.

Suitable examples of the organic solvents having a high boiling point which can be employed in an oil droplet-in-water type dispersing method are described, for example, in U.S. Pat. No. 2,322,027.

Specific examples of the organic solvents have a high boiling point of at least 175° C. at a normal pressure and can be employed in the oil droplet-in-water type dispersing method include phthalic acid esters (for example, dibutyl phthalate, dicyclohexyl phthalate, di-2-ethylhexyl phthalate, didecyl phthalate, bis(2,4-di-tert-amylphenyl)phthalate, bis(2,4-di-tert-amylphenyl-)isophthalate, or bis(1,1-diethylpropyl)phthalate), phosphonic acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, or di-2-ethylhexyl phenylphosphonate), benzoic acid esters (for example, 2-ethylhexyl benzoate, dodecyl benzoate, or 2-ethylhexyl-p-hydroxybenzoate), amides (for example, N,N-diethyldodecanamide, N,N-diethyllaurylamide, or N-tetradecylpyrrolidone), alcohols or phenols (for example, isostearyl alcohol, or 2,4-di-tert-amylphenol), aliphatic carboxylic acid esters (for example, bis(2-ethylhexyl)sebacate, dioctyl azelate, gycerol tributyrate, isostearyl lactate, or trioctyl citrate), aniline derivatives (for example, N,N-dibutyl-2-butoxy-5-tertoctylaniline), and hydrocarbons (for example, paraffin, dodecylbenzene, or diisopropylnaphthalene).

Further, an organic solvent having a boiling point of at least about 30° C. and preferably having a boiling point of above 50° C. to about 160° C. can be used as an auxiliary solvent. Typical examples of the auxiliary solvents include ethyl acetate, butyl acetate, ethyl propionate, methyl ethyl ketone, cyclohexanone, 2-ethoxyethyl acetate, or dimethylformamide.

The processes and effects of latex dispersing methods and specific examples of latexes for impregnation are described, for example, in U.S. Pat. No. 4,199,363, West German Patent Application (OLS) Nos. 2,541,274 and 2,541,230.

Suitable supports which can be used in the present invention are described, for example, in Research Disclosure, No. 17643, page 28 and ibid., No. 18716, page 647, right column to page 648, left column, as mentioned above.

The present invention can be used for various types of color photographic light-sensitive materials, including color negative films for photographing (for general use or cinematography), color reversal films (for slides or television, both containing and not containing couplers), color papers, color positive films (for cinematography), color reversal papers, and direct positive color light-sensitive materials. Particularly, it can be preferably used for color negative films for photographing or color reversal films.

The color photographic light-sensitive material according to the present invention can be subjected to development processing in a conventional manner as described in *Research Disclosure,* No. 17643, pages 28 to 29 and ibid., No. 18716, page 651, left column to right column, as mentioned above.

A color developing solution which can be used in the development processing of the color photographic light-sensitive material of the present invention is an alkaline aqueous solution preferably containing an aromatic primary amine type color developing agent as a main component. As the color developing agent, while an aminophenol type compound is useful, a p-phenylenediamine type compound is preferable. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and sulfates, hydrochlorides and p-toluenesulfonates thereof.

Two or more kinds of color developing agents may be employed in a combination thereof, depending on the purpose.

The color developing solution can ordinarily contain: pH buffering agents, such as carbonates, borates or phosphates of alkali metals; and development inhibitors or anti-fogging agents such as bromides, iodides, benzimidazoles, benzothiazoles, and mercapto compounds. Further, if desired, the color developing solution may contain various preservatives (such as hydroxylamine, diethylhydroxylamine, sulfites, hydrazines, phenylsemicarbazides, triethanolamine, catechol sulfonic acids, and triethylenediamine(1,4-diazabicyclo[2,2,2]octane)); organic solvents (such as ethyleneglycol, or diethylene glycol); development accelerators (such as benzyl alcohol, polyethylene glycol, quarternary ammonium salts, or amines); dye forming couplers; competing couplers; fogging agents such as sodium borohydride; auxiliary developing agents such as 1-phenyl-3-pyrazolidone; viscosity imparting agents; and various chelating agents (such as aminopolycarboxylic acids, aminopolyphosphonic acids, alkylphosphonic acids, and phosphonocarboxylic acids). Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine N,N,N,N-tetramethylenephosphonic acid, ethylenediamine di(ohydroxyphenylacetic acid), and salts thereof.

With reversal processing, color development is usually conducted after black-and-white development. In a black-and-white developing solution, known black-and-white developing agents, for example, dihydroxybenzenes such as hydroquinone, 3-pyrazolidones such as 1-phenyl-3-pyrazolidone, and aminophenols such as N-methyl-p-aminophenol may be employed individually or in a combination.

The pH of the color developing solution or the black-and-white developing solution is usually in the range of 9 to 12. Further, the amount of replenishment for the developing solution can be varied depending on color photographic light-sensitive materials to be processed. But it is generally not more than 3 liters per square meter of the photographic light-sensitive material. The amount of replenishment can be reduced to not more than 500 ml by decreasing the bromide ion concentration in the replenisher. To reduce the amount of replenishment, it is preferred to prevent evaporation and aerial oxidation of the processing solution by reducing the area of the processing tank which is in contact with the air. Further, the amount of replenishment can be reduced by using a means which restrains accumulation of bromide ion in the developing solution.

The processing time of the color development is usually in a range of 2 to 5 minutes. However, it is possible to reduce the processing time by performing the color development at high temperature and high pH using a high concentration of color developing agent.

After color development, the photographic emulsion layers are usually subjected to a bleach processing. The bleach processing can be performed simultaneously with a fix processing (bleach-fix processing), or it can be performed independently from the fix processing. Further, for the purpose of rapid processing, a processing method wherein, after a bleach processing, a bleach-fix processing is performed may be employed. Moreover, depending on the purpose it may be appropriate to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(IV), or copper(II); peracids; quinones; and nitro compounds. Representative examples of the bleaching agents include: ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid) and complex salts of organic acids (such as citric acid, tartaric acid, or malic acid); persulfates; bromates; permanganates; and nitrobenzenes. Of these compounds, iron(III) complex salts of aminopolycarboxylic acids, representatively exemplified by iron(III) complex salt of ethylenediaminetetraacetic acid and persulfates, are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in the range of 3.5 to 8. For the purpose of rapid processing, it is possible to process at a pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond described, for example, in U.S. Pat. No. 3,893,858, West German Patents 1,290,812 and 2,059,988, JP-A-53-32736 JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (July 1978); thiazolidine derivatives described, for example, in JP-A-50-140129; thiourea derivatives described, for example, in JP-B-45-8506, JP-A-52-20832, JP-A-53-32735 and U.S. Pat. No. 3,706,561; iodides described, for example, in West German Patent 1,127,715 and JP-A-58-16235; polyoxyethylene compounds described, for example, in West German Patents 966,410 and 2,748,430; polyamine compounds described, for example, in JP-B-45-8836; compounds described, for example, in JP-A-49-42434, JP-A-49-59644, JP-A-53-94927, JP-A-54-35727, JP-A-55-26506, and JP-A-58-163940; and bromide ions. Of these compounds, the compounds having a mercapto group or a disulfide bond are preferred in view of their large bleach accelerating effect. Particularly, the compounds described in U.S. Pat. No. 3,893,858, West German Patent 1,290,812, JP-A-53-95630 and U.S. Pat. No. 4,552,834 are preferred. These bleach accelerating agents may be incorporated into the color photographic light-sensitive material. These bleach accelerating agents are particularly effectively employed when color photographic light sensitive materials for photographing are subjected to bleach-fix processing.

Examples of fixing agents which can be employed in the fixing solution or bleach-fixing solution include thiosulfates, thiocyanate, thioether compounds, thioureas, and a large amount of iodide. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

The amount of water required for the water washing step may be set in a wide range depending on characteristics of the photographic light-sensitive materials (the elements used therein, for example, couplers, etc.), the uses thereof, the temperature of washing water, the number of water washing tanks (stages), the nature of the replenishment system such as countercurrent or co-current, or other conditions. The relationship between a number of water washing tanks and an amount of water in a multi-stage countercurrent system can be determined based on the method as described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, an increase in residence time of the water in a tank cause the propagation of bacteria and other problems such as adhesion of floatage formed on the photographic materials occur. In the method of processing the silver halide color photographic material according to the present invention, a step to reduce amounts of calcium ions and magnesium ions as described in JP-A-62-288838 can be particularly effectively employed in order to solve such problems. Further, sterilizers can be employed, for example, isothiazolone compounds described in JP-A-57-8542, thiabendazoles, chlorine type sterilizers such as sodium chloroisocyanurate, benzotriazoles, sterilizers described in Hiroshi Horiguchi, *Bokin-Bobai No Kaqaku, Biseibutsu No Mekkin-, Sakkin-, Bobai-Gijutsu,* edited by Eiseigijutsu Kai, and *Bokin-Bobaizai Jiten,* edited by Nippon Bokin-Bobai Gakkai.

The pH of the washing water used in the processing of the photographic light-sensitive materials according to the present invention is usually 4 to 9, preferably 5 to 8. The temperature of washing water and the time for a water washing step can be variously set depending on characteristics or uses of photographic light-sensitive materials. However, it is common to select a range of 15° to 45° C. and a period of 20 sec. to 10 min. and preferably a range of 25° to 40° C. and a period of 30 sec. to 5 min.

The photographic light-sensitive material of the present invention can also be directly processed with a stabilizing solution instead of the above-described water washing step. In such a stabilizing process, any of known methods described, for example, in JP-A-57-8543, JP-A-58-14834 and JP-A-60-220345 can be employed.

Further, it is possible to perform the stabilizing process subsequent to the above-described water washing process. One example thereof is a stabilizing bath, containing formaldehyde and a surface active agent, which is employed as a final bath in the processing of color photographic light-sensitive materials for photographing. To such a stabilizing bath, various chelating agents and antimolds may also be added.

Overflow solutions resulting from the replenishment of the above-described washing water and/or stabilizing solution may be reused in other steps such as the desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include: indoaniline type compounds described in U.S. Pat. Nos. 3,342,597, Schiff's base type compounds described in U.S. Pat. No. 3,342,599 and *Research Disclosure,* No. 14850 and ibid., No. 15159, aldol compounds described in *Research Disclosure,* No. 13924, metal complex salts described in U.S. Pat. No. 3,719,492, and urethane type compounds described in JP-A-53-135628.

Further, the silver halide color photographic material according to the present invention may contain, if desired, various 1-phenyl-3-pyrazolidones to accelerate color development. Typical examples of these compounds include those described, for example in JP-A--64339, JP-A-57-144547, and JP-A-58-115438.

In the present invention, various kinds of processing solutions can be employed at a temperature range of 10° to 50° C. Although the standard temperature is of 33° to 38° C., it is possible to carry out the processing at higher temperatures to accelerate the processing whereby the processing time is shortened, or at lower temperatures to improve image quality and to maintain the stability of the processing solutions.

Further, to save the amount of silver employed in the color photographic light-sensitive material, the photographic processing may be performed utilizing color intensification using cobalt or hydrogen peroxide as described in West German Patent 2,226,770 or U.S. Pat. No. 3,674,499.

In accordance with the present invention, a bleach accelerating agent can be incorporated into a color light-sensitive material in a stable form even under high temperature and high humidity conditions, to improve the desilvering property.

The present invention is explained in greater detail with reference to the following examples, but the present invention should not be construed as being limited thereto.

EXAMPLE 1

Preparation of Sample 101

On a cellulose triacetate film support provided with a subbing layer was coated each layer having the composition shown below to prepare a multilayer color light-sensitive material which was designated Sample 101.

Regarding the composition of the layers, the coating amounts of the silver halide and the colloidal silver are shown by units of g/m$^2$ of silver; the coated amounts of couplers, additives and gelatin are shown by units of g/m$^2$; and the coating amounts of sensitizing dyes are shown by a molar amount per mol of silver halide present in the same layer.

| | |
|---|---|
| First Layer: Antihalation Layer | |
| Black colloidal silver | 0.2 (as silver) |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| Second Layer: Intermediate Layer | |
| Fine grain silver bromide (average particle size: 0.07 μm) | 0.10 (as silver) |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| Third Layer: | |
| First Red-Sensitive Emulsion Layer | |
| Silver iodobromide emulsion (silver iodide: 2 mol %; internal high silver iodide type; diameter corresponding to sphere: 0.3 μm; coefficient of variation of diameter corresponding to sphere: 29%; mixture of regular crystals and twin crystals; diameter/thickness ratio: 2.5) | 0.4 (as silver) |
| Gelatin | 0.6 |
| ExS-1 | $1 \times 10^{-4}$ |
| ExS-2 | $3 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-3 | 0.012 |
| Fourth Layer: | |
| Second Red-Sensitive Emulsion Layer | |
| Silver iodobromide emulsion (silver iodide: 5 mol %; internal high silver iodide type; diameter corresponding to sphere: 0.7 μm; coefficient of variation of diameter corresponding to sphere: 25%; mixture of regular crystals and twin crystals; diameter/thickness ratio: 4) | 0.7 (as silver) |
| Gelatin | 0.5 |
| ExS-1 | $1 \times 10^{-4}$ |
| ExS-2 | 3 × 10-4 |
| ExS-3 | $1 \times 10^{-4}$ |
| ExC-3 | 0.24 |
| ExC-4 | 0.24 |
| ExC-7 | 0.04 |
| ExC-2 | 0.04 |
| Solv-1 | 0.15 |
| Solv-3 | 0.02 |
| Fifth Layer: | |
| Third Red-Sensitive Emulsion Layer | |
| Silver iodobromide emulsion (silver iodide: 10 mol %; internal high silver iodide type; diameter corresponding to sphere: 0.8 μm; coefficient of variation of diameter corresponding to sphere: 16%; mixture of regular crystals and twin crystals; diameter/thickness ratio: 1.3) | 1.0 (as silver) |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.01 |
| ExC-6 | 0.13 |
| Solv-1 | 0.01 |
| Solv-2 | 0.05 |
| Six Layer: Intermediate Layer | |
| Gelatin | 1.0 |
| Cpd-1 | 0.03 |
| Solv-1 | 0.05 |
| Seventh Layer: | |
| First Green-Sensitive Emulsion Layer | |
| Silver iodobromide emulsion (silver iodide: 2 mol %; internal high silver iodide type; diameter corresponding to sphere: 0.3 μm; coefficient of variation of diameter corresponding to sphere: 28%; mixture of regular crystals and twin crystals; diameter/thickness ratio: 2.5) | 0.3 (as silver) |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |
| Eighth Layer: | |
| Second Green-Sensitive Emulsion Layer | |
| Silver iodobromide emulsion (silver iodide: 4 mol %; internal high silver iodide type; diameter corresponding to sphere: 0.6 μm; coefficient of variation of diameter corresponding to sphere: 38%; mixture of regular crystals and twin crystals; diameter/thickness ratio: 4) | 0.4 (as silver) |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |
| Ninth Layer: | |
| Third Green-Sensitive Emulsion Layer | |
| Silver iodobromide emulsion (silver iodide: 6 mol %; internal high silver | 0.85 (as silver) |

-continued

| | |
|---|---|
| iodide type; diameter corresponding to sphere: 1.0 μm; coefficient of variation of diameter corresponding to sphere: 80%; mixture of regular crystals and twin crystals; diameter/thickness ratio: 1.2) | |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| Tenth Layer: Yellow Filter Layer | |
| Gelatin | 1.2 |
| Yellow colloidal silver | 0.08 (as silver) |
| Cpd-2 | 0.1 |
| Solv-1 | 0.3 |
| Eleventh Layer: First Blue-Sensitive Emulsion Layer | |
| Silver iodobromide emulsion (silver iodide: 4 mol %; internal high silver iodide type; diameter corresponding to sphere: 0.5 μm; coefficient of variation of diameter corresponding to sphere: 15%; octahedral grains) | 0.4 (as silver) |
| Gelatin | 1.0 |
| ExS-9 | $2 \times 10^{-4}$ |
| ExY-16 | 0.9 |
| ExY-14 | 0.07 |
| Solv-1 | 0.2 |
| Twelfth Layer: Second Blue-Sensitive Emulsion Layer | |
| Silver iodobromide emulsion (silver iodide: 10 mol %; internal high silver iodide type; diameter corresponding to sphere: 1.3 μm; coefficient of variation of diameter corresponding to sphere: 25%; mixture of regular crystals and twin crystals; diameter/thickness ratio: 4.5) | 0.5 (as silver) |
| Gelatin | 0.6 |
| ExS-9 | $1 \times 10^{-4}$ |
| ExY-16 | 0.25 |
| Solv-1 | 0.07 |
| Thirteenth Layer: First Protective Layer | |
| Gelatin | 0.8 |
| UV-1 | 0.1 |
| UV-2 | 0.2 |
| Solv-1 | 0.01 |
| Solv-2 | 0.01 |
| Fourteenth Layer: Second Protective Layer | |
| Fine grain silver bromide (average particle size: 0.07 μm) | 0.5 (as silver) |
| Gelatin | 0.45 |
| Polymethyl methacrylate particle (diameter: 1.5 μm) | 0.2 |
| H-1 | 0.4 |
| Cpd-3 | 0.5 |
| Cpd-4 | 0.5 |

A surface active agent was added to each of the layers as a coating aid in addition to the above described components. Thus, Sample 101 was prepared.

The chemical structural formulae or chemical names of the compounds employed in this example are shown below.

UV-1

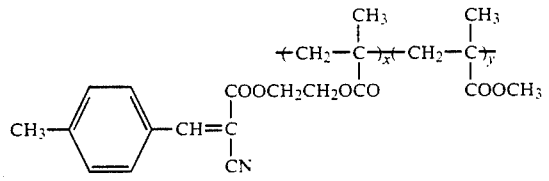

wherein x/y = 7/3 (in weight ratio)

UV-2

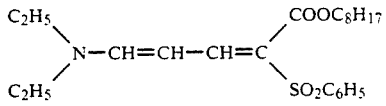

Solv-1: Tricresyl phosphate
Solv-2: Dibutyl phthalate
Solv-3: Bis(2-ethylhexyl)phthalate ExM-8

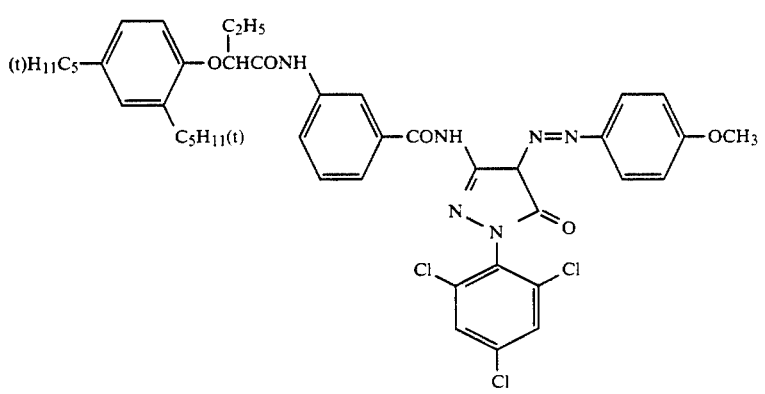

-continued
ExF-1
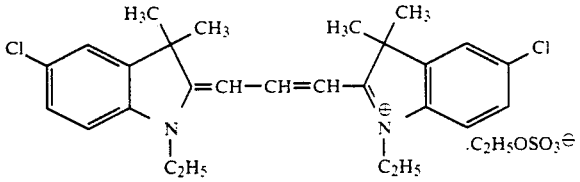
ExC-2
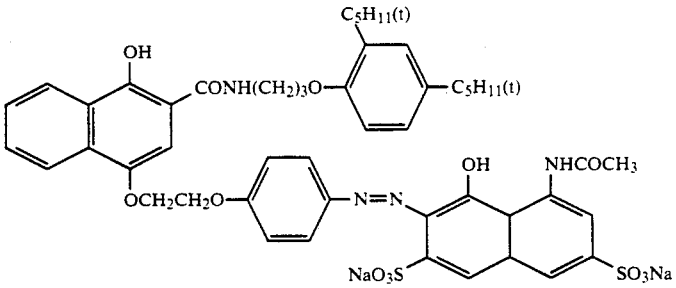
ExC-3
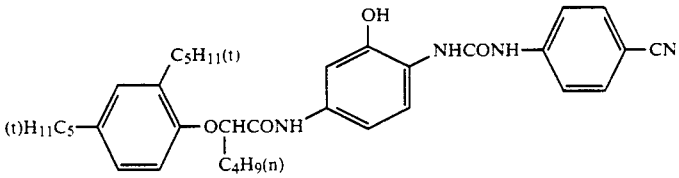
ExC-4
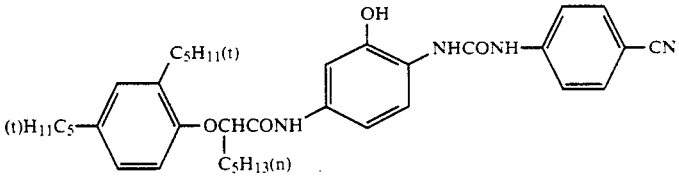
ExY-14
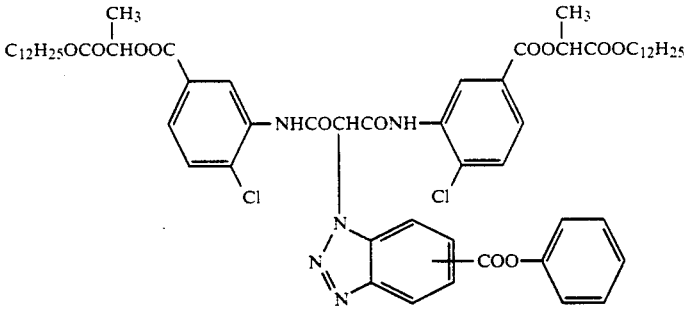
ExY-15
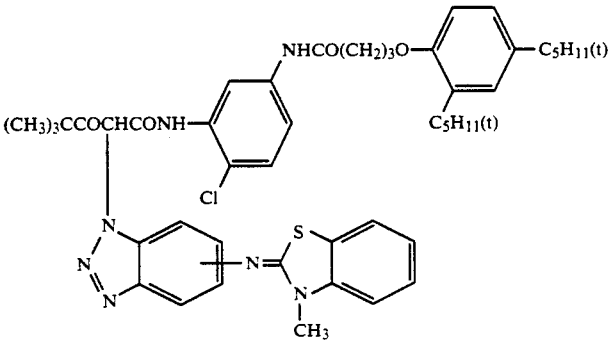

-continued
ExC-5
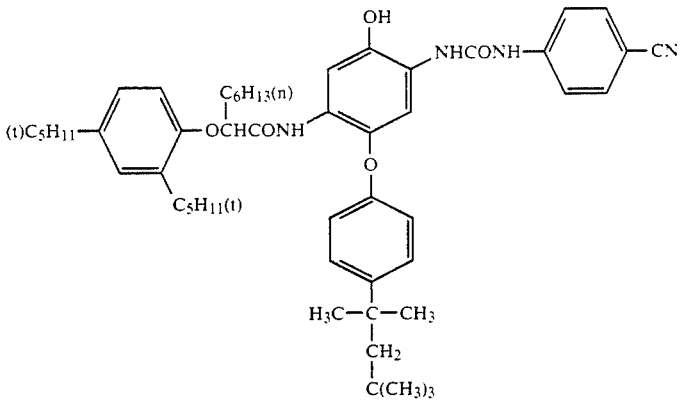
ExC-6
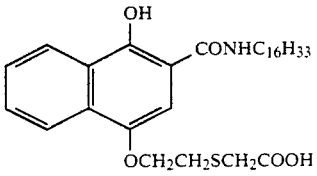
ExC-7
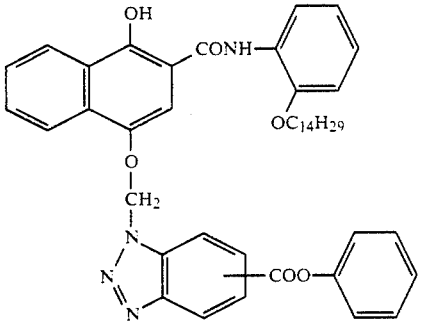
ExM-9
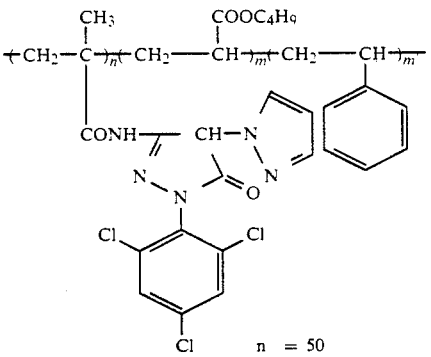
n = 50
m = 25
m' = 25
mol. wt. about 20,000
ExM-10
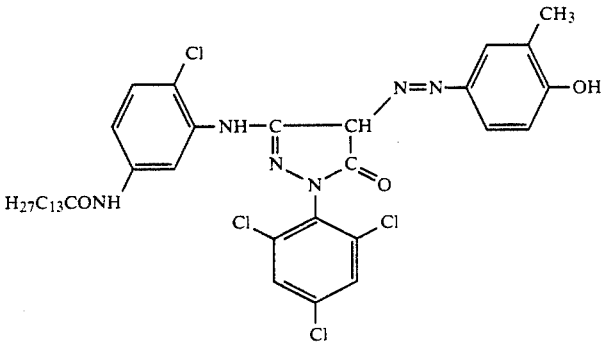

-continued
ExM-11
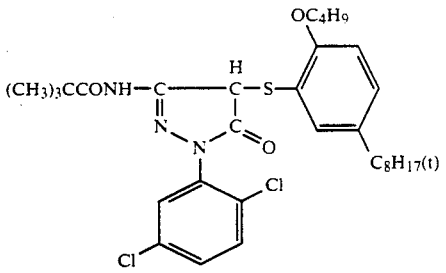
ExM-12
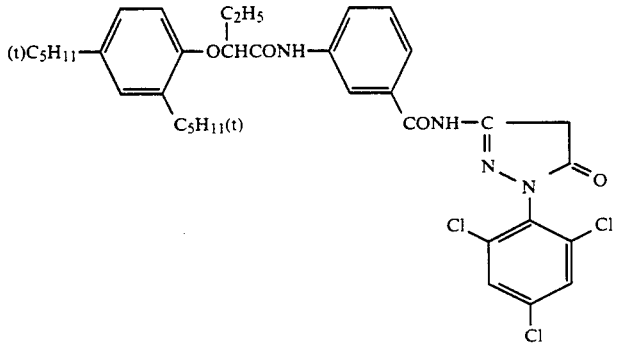
ExM-13
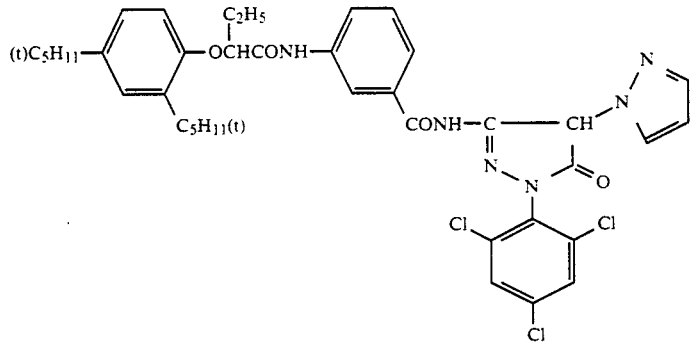
ExY-16
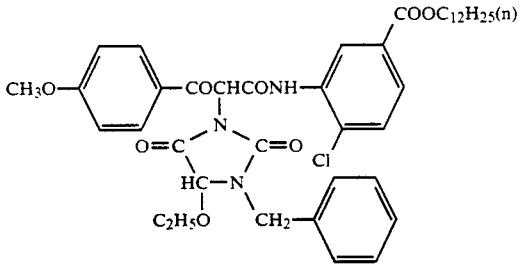
Cpd-1
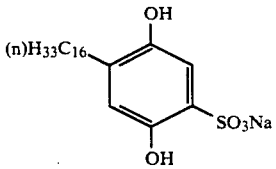
Cpd-2
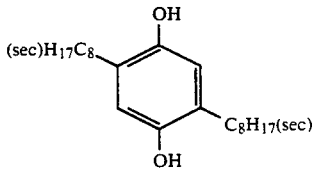

-continued
ExS-1
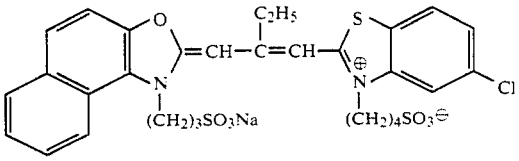
ExS-2
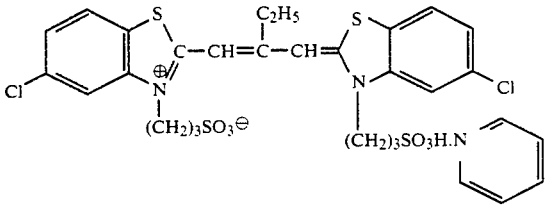
ExS-3
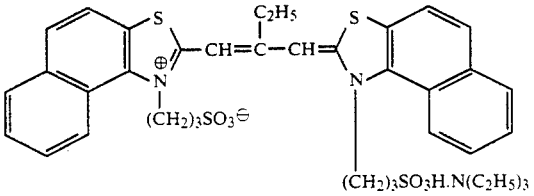
ExS-4
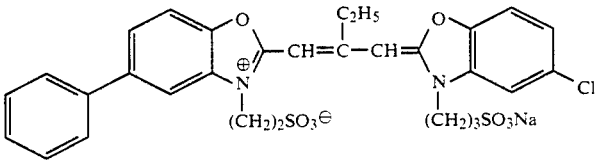
ExS-5
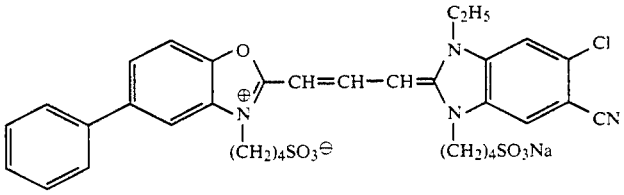
ExS-6
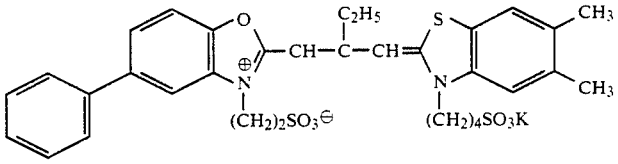
ExS-7
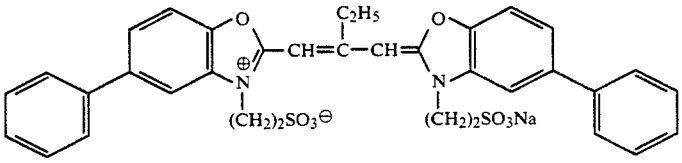
ExS-8
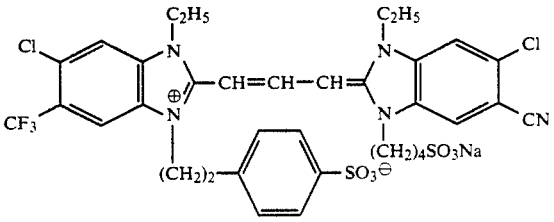

-continued

ExS-9

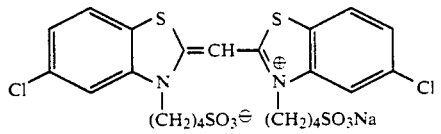

H-1

$CH_2{=}CH{-}SO_2{-}CH_2{-}CONH{-}CH_2$
$CH_2{=}CH{-}SO_2{-}CH_2{-}CONH{-}CH_2$

Cpd-3

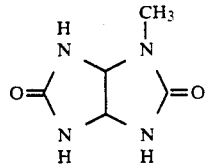

Cpd-4

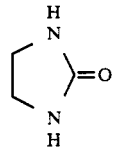

Preparation of Samples 102 and 103

Samples 102 and 103 were prepared in the same manner as described for Sample 101 except for using Comparative Compounds A and B in place of ExC-6 added to the fifth layer of Sample 101, respectively.

Preparation of Samples 104 and 115

Samples 104 to 115 were prepared in the same manner as described for Sample 101 except for adding an equimolar amount of Comparative Compounds C, D, E, F and G and the compounds according to the present invention as shown in Table 1 below, in addition to ExC-6, to the fifth layer of Sample 101, respectively.

Comparative Compound A:

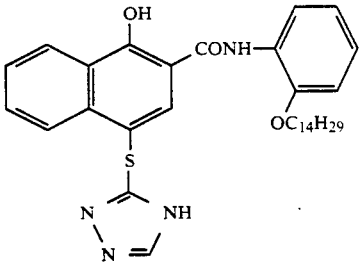

(the compound described in Research Disclosure, No. 11449 (1973))

Comparative Compound B:

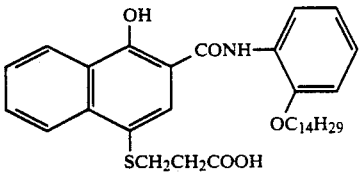

Comparative Compound C:

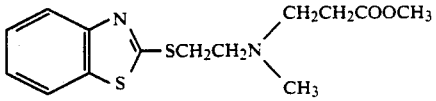

-continued

Comparative Compound D:

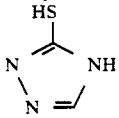

Comparative Compound E:
$HSCH_2CH_2COOH$

Comparative Compound F:

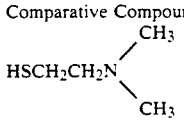

Comparative Compound G:

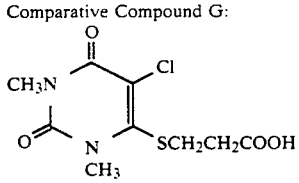

Samples 101 to 115 thus-obtained were cut into strips of a 35 m/m width, used to photograph standard subjects and subjected to a running test according to Processing Steps (I), (II) or (III) shown below with a 500 m length. After the running test, other strips of Samples 101 to 115 were exposed to a white light of 20 CMS through a step wedge and then subjected to the development processing according to Processing Steps (I), (II) or (III).

The amount of remaining silver in the maximum density area of each sample thus-processed was determined according to X-ray fluorometric analysis. The results obtained are shown in Table 1 below.

Further, in order to determine stability during preservation of Samples 101 to 115 before exposure to light, each sample was stored under the condition of 55° C. and 80%RH for 1 week and then subjected to the wedge exposure and development processing according Processing Step (II) in the same manner as described above to evaluate changes in photographic characteristics. The results obtained are also shown in Table 1 below.

| Processing Step (I): [Processing Temperature: 38° C.] | | |
|---|---|---|
| Processing Step | Processing Time | Amount of Replenishment* |
| Color Development | 3 min. 15 sec. | 15 ml |
| Bleaching | 3 min. 00 sec. | 5 ml |
| Fixing | 4 min. 00 sec. | 30 ml |
| Stabilizing (1) | 30 sec. | — |
| Stabilizing (2) | 30 sec. | — |
| Stabilizing (3) | 30 sec. | 30 ml |
| Drying | 1 min. 30 sec. (at 50° C.) | — |

*Amount of replenishment per 1 meter of a 35 m/m width strip

In the above described processing steps, the stabilizing steps (1), (2) and (3) were carried out using a countercurrent stabilizing system of (3)→(2) →(1). Further, the amount of fixing solution carried over to the stabilizing tank was 2 ml per meter of the strip.

The composition of each processing solution used is illustrated below.

| | Mother Liquor | Replenisher |
|---|---|---|
| Color Developing Solution: | | |
| Diethylenetriaminepenta-acetic Acid | 1.0 g | 2.0 g |
| 1-Hydroxyethylidene-1,1-diphosphonic Acid | 2.0 g | 3.3 g |
| Sodium Sulfite | 4.0 g | 5.0 g |
| Potassium Carbonate | 30.0 g | 38.0 g |
| Potassium Bromide | 1.4 g | — |
| Potassium Iodide | 1.3 mg | — |
| Hydroxylamine | 2.4 g | 3.2 g |
| 4-(N-Ethyl-N-β-hydroxy-ethylamino)-2-methyl-aniline Sulfate | 4.5 g | 7.2 g |
| Water to make | 1 l | 1 l |
| pH | 10.00 | 10.05 |
| Bleaching Solution: | | |
| Ammonium Iron (III) Ethylenediaminetetra-acetate | 50 g | 60 g |
| Ammonium Iron (III) 1,3-Diaminopropanetetra-acetate | 60 g | 72 g |
| Aqueous Ammonia | 7 ml | 5 ml |
| Ammonium Nitrate | 10.0 g | 12.0 g |
| Ammonium Bromide | 150 g | 170 g |
| Water to make | 1 l | 1 l |
| pH | 6.0 | 5.8 |
| Fixing Solution: | | |
| Disodium Ethylenediamine-tetraacetate | 1.0 g | 1.2 g |
| Sodium Sulfite | 4.0 g | 5.0 g |
| Sodium Bisulfite | 4.6 g | 5.8 g |
| Ammonium Thiosulfate (70 wt % aq. soln.) | 175 ml | 200 ml |
| Water to make | 1 l | 1 l |
| pH | 6.6 | 6.6 |
| Stabilizing Solution: | | |
| Formaldehyde (37% w/v) | 2.0 ml | 3.0 ml |
| Polyoxyethylene-p-monononylphenylether (average degree of polymerization: 10) | | |
| 5-Chloro-2-methyl-4-iso-thiazolin-3-one | 0.03 g | 0.045 g |
| Water to make | 1 l | 1 l |

| Processing Step (II): [Processing Temperature: 38° C.] | | |
|---|---|---|
| Processing Step | Processing Time | Amount of Replenishment* |
| Color Development | 3 Min. 15 sec | 15 ml |
| Bleaching | 1 min. 00 sec. | 10 ml |
| Bleach-Fixing | 3 min. 15 sec. | 15 ml |
| Washing with Water (1) | 40 sec. | — |
| Washing with Water (2) | 1 min. 00 sec. | 1200 ml |
| Stabilizing | 20 sec. | 15 ml |
| Drying | 1 min. 15 sec. (at 60° C.) | — |

*Amount of replenishment per 1 meter of a 35 m/m width strip

In the above described processing steps, the washing-with-water steps (1) and (2) were carried out using a countercurrent water washing system from Washing-with-Water (2) to Washing-with-Water (1).

The composition of each processing solution used is illustrated below.

| Color Developing Solution | Mother Liquor | Replenisher |
|---|---|---|
| Diethylenetriaminepenta-acetic Acid | 1.0 g | 1.1 g |
| 1-Hydroxyethylidene-1,1-diphosphonic Acid | 2.0 g | 2.2 g |
| Sodium Sulfite | 4.0 g | 4.9 g |
| Potassium Carbonate | 30.0 g | 42.0 g |
| Potassium Bromide | 1.6 g | — |
| Potassium Iodide | 2.0 mg | — |
| Hydroxylamine | 2.4 g | 3.6 g |
| 4-(N-Ethyl-N-β-hydroxy-ethylamino)-2-methyl-aniline Sulfate | 5.0 g | 7.3 g |
| Water to make | 1 l | 1 l |
| pH | 10.00 | 10.05 |
| | (both Mother Liquor and Replenisher) | |
| Bleaching Solution: | | |
| Ammonium Iron (III) Ethylene-diaminetetraacetate | 120.0 g | |
| Disodium Ethylenediaminetetra-acetate | 10.0 g | |
| Ammonium Nitrate | 10.0 g | |
| Ammonium Bromide | 100.0 g | |
| Adjusted pH with aqueous ammonia to | 6.3 | |
| Water to make | 1.0 l | |
| Bleach-Fixing Solution: | | |
| Ammonium Iron (III) Ethylene-diaminetetraacetate | 50.0 g | |
| Disodium Ethylenediaminetetra-acetate | 5.0 g | |
| Sodium Sulfite | 12.0 g | |
| Aqueous Solution of Ammonium Thiosulfate (70 wt %) | 240.0 ml | |
| adjusted pH with aqueous ammonia to | 7.3 | |
| Water to make | 1 l | |

Washing Water

Tap water which was passed through a column filled with a Na-type strong acidic cation exchange resin (Diaion SK-1B manufactured by Mitsubishi Chemical Industries Ltd.) to prepare water having the calcium content: 2 mg/l and the magnesium content: 1.2 mg/l was employed.

Stabilizing Solution

Same as described in Processing Step (I).

| Processing Step (III): [Processing Temperature: 38° C.] | | | |
|---|---|---|---|
| Processing Step | Processing Time | Capacity of Tank | Amount of Replenishment* |
| Color Development | 3 min. 15 sec. | 8 l | 15 ml |
| Bleach-Fixing | 2 min. 30 sec. | 8 l | 25 ml |
| Washing With Water (1) | 20 sec. | 4 l | Three-stage counter-current system 10 ml |
| Washing With Water (2) | 20 sec. | 4 l | |
| Washing With Water (3) | 20 sec. | 4 l | |
| Stabilizing | 20 sec. | 4 l | 10 ml |

*Amount of replenishment per 1 meter of a 35 m/m width strip

In the above described processing steps, the washing-with-water steps (1), (2) and (3) were carried out using a three-stage countercurrent washing-with-water system of (3)→(2)→(1).

The composition of each processing solution used is illustrated below.

| | Mother Liquor | Replenisher |
|---|---|---|
| Color Developing Solution: | | |
| Diethylenetriaminepenta-acetic Acid | 1.0 g | 1.2 g |
| 1-Hydroxyethylidene-1,1-diphosphonic Acid | 2.0 g | 2.4 g |
| Sodium Sulfite | 2.0 g | 4.8 g |
| Potassium Carbonate | 35.0 g | 45.0 g |
| Potassium Bromide | 1.6 g | — |
| Potassium Iodide | 2.0 mg | — |
| Hydroxylamine | 2.0 g | 3.6 g |
| 4-(N-Ethyl-N-β-hydroxy-ethylamino)-2-methyl-aniline Sulfate | 5.0 g | 7.5 g |
| Water to make | 1 l | 1 l |
| Adjusted pH with potassium hydroxide to | 10.20 | 10.35 |
| Bleach-Fixing Solution: | | |
| Iron (III) Ammonium Ethylenediaminetetra-acetate | 40 g | 45 g |
| Iron (III) Ammonium Diethylenetriaminepenta-acetate | 40 g | 45 g |
| Disodium Ethylenediamine-tetraacetate | 10 g | 10 g |

-continued

| | Mother Liquor | Replenisher |
|---|---|---|
| Sodium Sulfite | 15 g | 20 g |
| Aqueous Solution of Ammonium Thiosulfate (70% w/v) | 240 ml | 270 ml |
| Aqueous Ammonia (26 wt %) | 14 ml | 12 ml |
| Water to make | 1 l | 1 l |
| pH | 6.7 | 6.5 |

Washing Water

The following three kinds of washing water were employed:

[1] Tap Water

| | |
|---|---|
| Calcium | 26 mg/l |
| Magnesium | 9 mg/l |
| pH | 7.2 |

[2] Ion Exchanged Water

The above described tap water was treated with a Na-type strong acidic cation exchange resin manufactured by Mitsubishi Chemical Industries Ltd. to prepare water having the water quality as follows:

| | |
|---|---|
| Calcium | 1.1 mg/l |
| Magnesium | 0.5 mg/l |
| pH | 6.6 |

[3] Tap Water Containing Chelating Agent

To the above described tap water, was added disodium ethylenediaminetetraacetate in an amount of 500 mg per liter.

| | |
|---|---|
| pH | 6.7 |

TABLE 1

| Sample No. | Compound(s) Added to Fifth Layer | Amount of Remaining Silver: Processing Step (I) (mg/m²) | Processing Step (II) (mg/m²) | Processing Step (III) (mg/m²) | Sensitivity of* Red-Sensitive Layer (Processing Step (III)) | Decrease in Sensitivity** after Preservation at 55° C., 80% RH for 1 Week (Processing Step (II)) |
|---|---|---|---|---|---|---|
| 101 | ExC-6 | 45 | 82 | 144 | ±0 | −0.04 |
| 102 | A | 34 | 61 | 116 | +0.02 | −0.14 |
| 103 | B | 30 | 35 | 52 | +0.02 | −0.17 |
| 104 | ExC-6 C | 43 | 75 | 132 | −0.07 | −0.20 |
| 105 | ExC-6 D | 37 | 74 | 134 | −0.18 | −0.21 |
| 106 | ExC-6 E | 12 | 16 | 25 | −0.24 | −0.22 |
| 107 | ExC-6 F | 9 | 9 | 15 | −0.27 | −0.24 |
| 108 | ExC-6 G | 24 | 26 | 28 | −0.02 | −0.08 |
| 109 | ExC-6 (I-1) | 10 | 14 | 21 | −0.02 | −0.02 |
| 110 | ExC-6 (I-5) | 14 | 18 | 33 | −0.02 | −0.03 |
| 111 | ExC-6 (I-6) | 18 | 24 | 34 | −0.02 | −0.02 |
| 112 | ExC-6 (I-7) | 19 | 28 | 30 | −0.01 | −0.03 |
| 113 | ExC-6 (I-8) | 9 | 11 | 16 | −0.01 | −0.02 |
| 114 | ExC-6 (I-20) | 10 | 11 | 18 | −0.02 | −0.03 |
| 115 | ExC-6 (I-24) | 16 | 25 | 27 | −0.01 | −0.02 |

*log E value at a point having a density of fog + 0.2 using Sample 101 as standard.
**Difference between sensitivity of a sample preserved at 55° C. and 80% RH for 1 week and sensitivity of a sample preserved in a refrigerator at 5° C. for 1 week.

The sensitivities of the red-sensitive layer of the samples obtained from Processing Steps (I) and (II) were almost the same as those obtained from Processing Step (III), respectively.

From the results shown in Table 1 above, it can be seen that under the running condition the samples containing the compound of the present invention exhibit an excellent desilvering property and have a stable sensitivity, although the comparative Samples 102 and 103 exhibit a large amount of remaining silver (i.e., residual silvers), and the comparative Samples 104 to 107 exhibit a large change in sensitivity.

Specifically, with Processing Step (I), the amount of remaining silver in the samples according to the present invention can be reduced to $\frac{1}{4}$ to $\frac{1}{2}$ of that in Sample 101 which does not contain a bleach accelerating agent. Also, with Processing Step (II), the amount of remaining silver can be reduced to $\frac{1}{8}$ to $\frac{1}{3}$. Further, it can be reduced to $\frac{1}{8}$ to $\frac{1}{4}$ with Processing Step (III).

Additionally, each of Comparative Compounds C, D, E and F was added to the bleach-fixing solution of Processing Step (III). Using the bleach-fixing solution, Sample 101 was subjected to a running processing and thereafter another strip of Sample 101 was subjected to the wedge exposure and development processing in the same manner as described above to determine the amount of remaining silver. From the results, it is apparent that these comparative compounds exhibit only slight silver removal accelerating effect compared to when the comparative compound is not added to the bleach-fixing solution.

Further, the amount of remaining silver was determined by the same manner as described above except for shortening the bleach-fixing time from 3 min. 15 sec. to 2 min. in Processing Step (II}. As a result, it became apparent that Samples 109 to 114 containing the compound of the present invention and Samples 104 to 108 yielded almost same amount of remaining silver, although the amount of remaining silver in Samples 101 to 103 was about twice as much. Similar results were obtained when the bleaching time was reduced from 3 min. to 1 min. 30 sec. in Processing Step (I).

Among Samples 102, 103 and 108 containing the comparative compounds A, B and G of precursor type corresponding to the compound of the present invention, respectively, Samples 102 and 103 exhibit a remarkable deterioration of their desilvering property in comparison with the sample containing the compound of the present invention, when the bleaching time is reduced. On the other hand, the stability in the preservation of Sample 108 is poor as compared with that of the sample containing the compound of the present invention.

EXAMPLE 2

Preparation of Sample 201

On a cellulose triacetate film support provided with a subbing layer, the layers having the composition set forth below were coated to prepare a multilayer color light-sensitive material which was designated as Sample 201.

With respect to the composition of the layers, the coated amounts of the silver halide and the colloidal silver are shown by g/m$^2$ units of silver; the coated amounts of couplers, additives and gelatin are shown by 9/m$^2$ units: and the coating amounts of sensitizing dyes are shown by molar amount per mol of silver halide present in the same layer.

| | |
|---|---|
| First Layer: Antihalation Layer | |
| Black colloidal silver | 0.2 (as silver) |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer: Intermediate Layer | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer: | |
| Low-Speed Red-Sensitive Emulsion Layer | |
| Silver iodobromide emulsion (AgI: 4 mol %, uniform AgI type, diameter corresponding to sphere: 0.5 μm, coefficient of variation of diameter corresponding to sphere: 20%, tabular grain, diameter/thickness ratio: 3.0) | 1.2 g (as silver) |
| Silver iodobromide emulsion (AgI: 3 mol %, uniform AgI type, diameter corresponding to sphere: 0.3 μm, coefficient of variation of diameter corresponding to sphere: 15%, spherical grain, diameter/thickness ratio: 1.0) | 0.6 (as silver) |
| Gelatin | 1.0 |
| ExS-1 | $4 \times 10^{-4}$ |
| ExS-2 | $5 \times 10^{-4}$ |
| ExC-1 | 0.05 |
| ExC-2 | 0.50 |
| ExC-3 | 0.03 |
| ExC-4 | 0.12 |
| ExC-5 | 0.01 |
| Fourth Layer: | |
| High-Speed Red-sensitive Emulsion Layer | |
| Silver iodobromide emulsion (AgI: 6 mol %, internal high AgI type with core/shell ratio of 1/1, diameter corresponding to sphere: 0.7 μm, coefficient of variation of diameter corresponding to sphere: 15%, tabular grain, diameter/thickness ratio: 5.0) | 0.7 (as silver) |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer: Intermediate Layer | |
| Gelatin | 0.5 |
| Cpd-1 | 0.1 |
| Solv-1 | 0.05 |
| Sixth Layer: | |
| Low-Speed Green-Sensitive Emulsion Layer | |
| Silver iodobromide emulsion (AgI: 4 mol %, surface high AgI type with core/shell ratio of 1/1, diameter corresponding to sphere: 0.5 μm, coefficient of variation of diameter corresponding to sphere: 15%, tabular grain, diameter/thickness ratio: 4.0) | 0.35 (as silver) |
| Silver iodobromide emulsion (AgI: 3 mol %, uniform AgI type, diameter corresponding to sphere: 0.3 μm, coefficient of variation of diameter corresponding to sphere: 25%, spherical grain, diameter/thickness ratio: 1.0) | 0.20 (as silver) |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |

-continued

| | |
|---|---|
| ExM-10 | 0.02 |
| ExY-11 | 0.03 |
| Solv-1 | 0.3 |
| Solv-4 | 0.05 |
| Seventh Layer: | |
| High-Speed Green-sensitive Emulsion Layer | |
| Silver iodobromide emulsion (AgI: 4 mol %, internal high AgI type with core/shell ratio of 1/3, diameter corresponding to sphere: 0.7 μm, coefficient of variation of diameter corresponding to sphere: 20%, tabular grain, diameter/thickness ratio: 5.0) | 0.8 (as silver) |
| Gelatin | 0.7 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer: Intermediate Layer | |
| Gelatin | 0.5 |
| Cpd-1 | 0.05 |
| Solv-1 | 0.02 |
| Ninth Layer: Donor Layer of Interimage Effect to Red-Sensitive Layer | |
| Silver iodobromide emulsion (AgI: 2 mol %, internal high AgI type with core/shell ratio of 2/1, diameter corresponding to sphere: 1.0 μm, coefficient of variation of diameter corresponding to sphere: 15%, tabular grain, diameter/thickness ratio: 6.0) | 0.35 (as silver) |
| Silver iodobromide emulsion (AgI: 2 mol %, internal high AgI type with core/shell ratio of 1/1, diameter corresponding to sphere: 0.4 μm, coefficient of variation of diameter corresponding to sphere: 20%, tabular grain, diameter/thickness ratio: 6.0) | 0.20 (as silver) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer: Yellow Filter Layer | |
| Yellow colloidal silver | 0.05 (as silver) |
| Gelatin | 0.5 |
| Cpd-2 | 0.13 |
| Cpd-1 | 0.10 |
| Eleventh Layer: | |
| Low-Sensitive Blue-Sensitive Emulsion Layer | |
| Silver iodobromide emulsion (AgI: 4.5 mol %, uniform AgI type, diameter corresponding to sphere: 0.7 μm, coefficient of variation of diameter corresponding to sphere: 15%, tabular grain, diameter/thickness ratio: 7.0) | 0.3 (as silver) |
| Silver iodobromide emulsion (AgI: 3 mol %, uniform AgI type, diameter corresponding to sphere: 0.3 μm, coefficient of variation of diameter corresponding to sphere: 25%, tabular grain, diameter/thickness ratio: 7.0) | 0.15 (as silver) |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExY-17 | 1.0 |
| Solv-1 | 0.20 |
| Twelfth Layer: High-Speed Blue-Sensitive Emulsion Layer | |
| Silver iodobromide emulsion (AgI: 10 mol %, internal high AgI type, diameter corresponding to sphere: 1.0 μm, coefficient of variation of diameter corresponding to sphere: 25%, multiple twin tabular grain, diameter/thickness ratio: 2.0) | 0.5 (as silver) |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer: First Protective Layer | |
| Gelatin | 0.8 |
| UV-4 | 0.1 |
| UV-5 | 0.15 |
| Solv-1 | 0.01 |
| Solv-2 | 0.01 |
| Fourteenth Layer: Second Protective Layer | |
| Fine grain silver iodobromide emulsion (AgI: 2 mol %, uniform AgI type, diameter corresponding to sphere: 0.07 μm) | 0.5 (as silver) |
| Gelatin | 0.45 |
| Polymethyl methacrylate particle (diameter: 1.5 μm) | 0.2 |
| H-1 | 0.4 |
| Cpd-3 | 0.5 |
| Cpd-4 | 0.5 |

Each layer described above contained a stabilizer for emulsion (Cpd-3:0.04 g/m$^2$) and a surface active agent (Cpd-4: 0.02 g/m$^2$) as a coating aid in addition to the above described compounds. Further, compounds (Cpd-5:0.5 g/m$^2$, Cpd-6:0.5 g/m$^2$) were added.

The structure of the compounds used for the preparation of Sample 201 are illustrated below:

UV-1

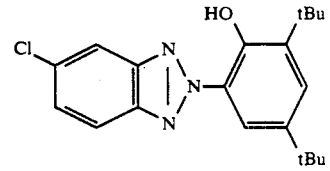

UV-2

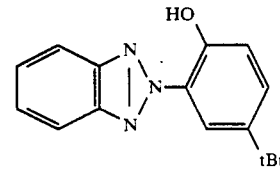

-continued
UV-3
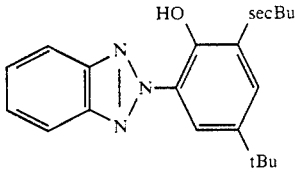
UV-4 Same as UV-1 in Example 1.
UV-5 Same as UV-2 in Example 1.
Solv-1 Tricresyl phosphate
Solv-2 Dibutyl phthalate
Solv-3
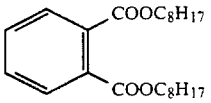
Solv-4
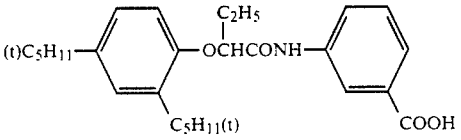
Cpd-1
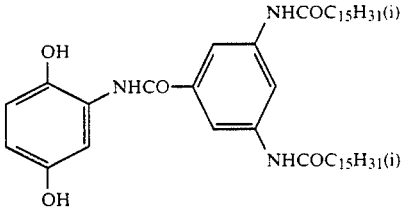
Cpd-2
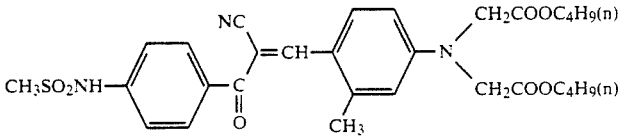
Cpd-3
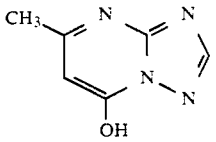
Cpd-4
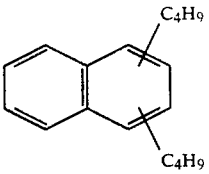
Cpd-5 Same as Cpd-3 in Example 1.
Cpd-6 Same as Cpd-4 in Example 1.
ExC-1 Same as ExC-3 in Example 1.
ExC-2
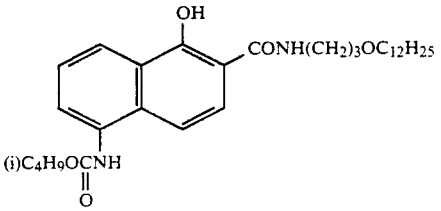

-continued
ExC-3
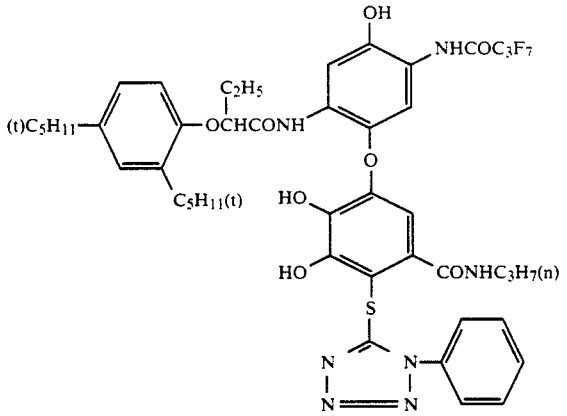
ExC-4 Same as ExC-2 in Example 1.
ExC-5 Same as ExC-7 in Example 1.
ExC-6 Same as ExC-5 in Example 1.
ExC-7
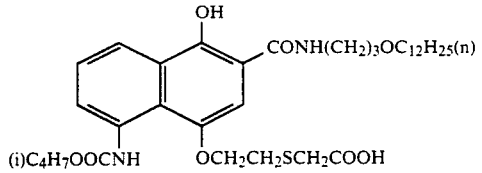
ExM-8 Same as ExM-9 in Example 1.
ExM-9
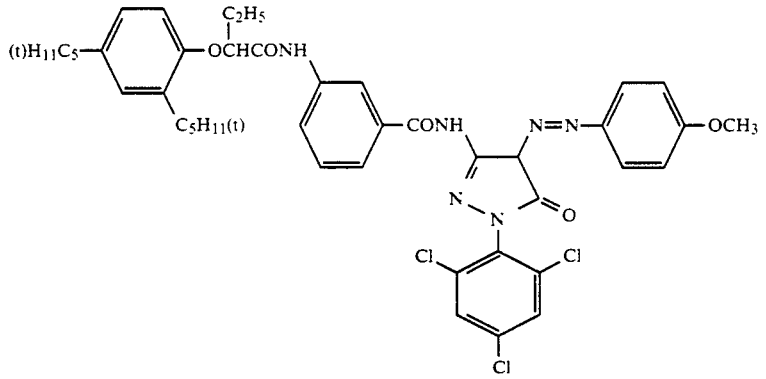
ExM-10 Same as ExM-10 in Example 1.
ExY-11 Same as ExY-15 in Example 1.
ExM-12
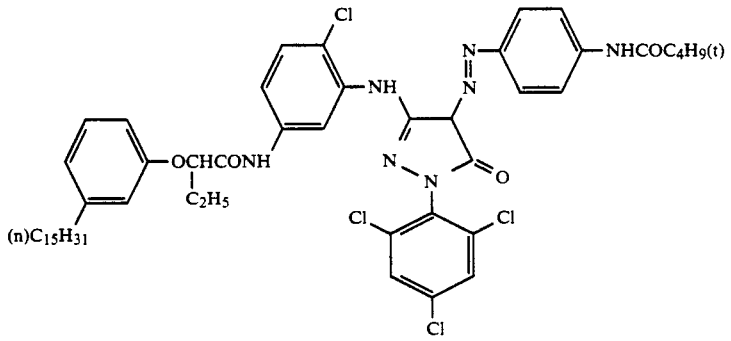
ExY-13 Same as ExY-14 in Example 1.
ExM-14 Same as ExM-13 in Example 1.

-continued

ExY-15 Same as ExY-16 in Example 1.

ExS-1 Same as ExS-1 in Example 1.

ExS-2 Same as ExS-2 in Example 1.

ExS-3

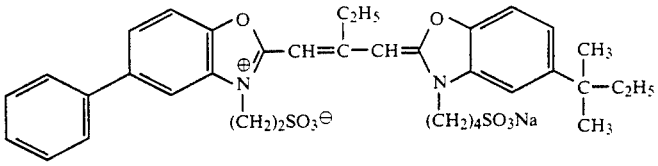

ExC-16

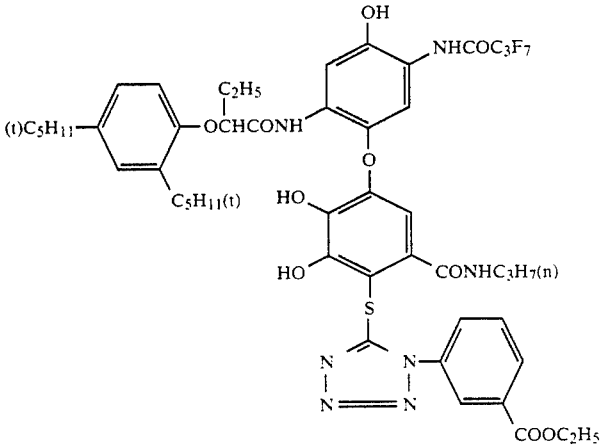

ExY-17

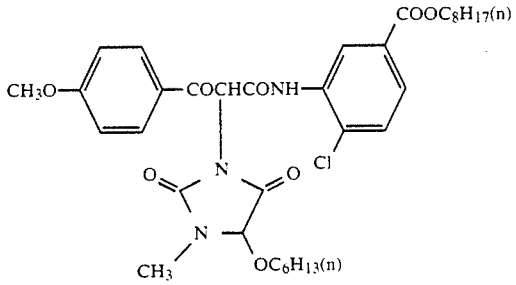

ExS-4 Same as ExS-4 in Example 1.

ExS-5 Same as ExS-6 in Example 1

ExS-6 Same as ExS-9 in Example 1.

H-1 Same as H-1 in Example 1.

ExF-1

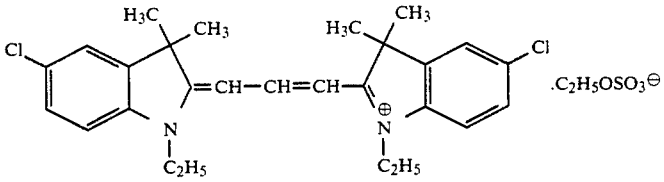

Samples 202 to 214

Samples 202 to 214 were prepared in the same manner as described for Sample 201 except that the compounds as used in Samples 102 to 114 of Example 1 were added to the second layer of Sample 201 in an amount of $2\times10^{-4}$ mol/m$^2$, respectively.

These samples thus-prepared were subjected to the running processing according to Processing Step (III) in the same manner as described in Example 1. Then, other strips of these samples were subjected to the wedge exposure and development processing in the same manner as described in Example 1. After the processing, the amount of remaining silver of each sample was measured. The results are shown in Table 2 below.

From the results shown in Table 2 below, it is apparent that the compounds of the present invention exhibit a sufficiently high desilverisng accelerating effect when added to a light-sensitive intermediate layer.

TABLE 2

| Sample No. | Compound Added to Second Layer | Amount of Remaining Silver | Sensitivity of* Red-Sensitive Layer | Remark |
|---|---|---|---|---|
| 201 | none | 120 | ±0 | Comparison |
| 202 | A | 103 | +0.01 | " |
| 203 | B | 92 | +0.01 | " |
| 204 | C | 90 | −0.02 | " |
| 205 | D | 44 | −0.02 | " |
| 206 | E | 16 | −0.22 | " |
| 207 | F | 16 | 0.23 | " |
| 208 | (I-1) | 15 | ±0 | Invention |
| 209 | (I-2) | 17 | −0.01 | " |
| 210 | (I-6) | 21 | ±0 | " |
| 211 | (I-7) | 23 | ±0 | " |
| 212 | (I-8) | 18 | ±0 | " |
| 213 | (I-20) | 19 | −0.01 | " |
| 214 | (I-24) | 22 | ±0 | " |

*Log E value at a point having a density of fog + 0.2 using Sample 201 as standard.

EXAMPLE 3

Preparation of Sample 301

On a cellulose triacetate film support provided with a subbing layer, the layers having the composition set forth below were coated to prepare a multilayer color light-sensitive material which was designated Sample 301.

With respect to the composition of the layers, the coating amounts of the silver halide and the colloidal silver are shown by g/m$^2$ units of silver; the coating amounts of the couplers, additives and gelatin are shown by g/m$^2$ units; and the coating amounts of sensitizing dyes are shown by molar amount per mol units of silver halide present in the same layer.

The symbols which indicate the additives used below have the following function. When an additive has two or more functions, one of them is indicated as being representative.

UV: Ultraviolet light absorbing agent.
Solv: Organic solvent having a high boiling point.
ExF: Dye.
ExS: Sensitizing dye.
ExC: Cyan coupler.
ExM: Magenta coupler.
ExY: Yellow coupler.
Cpd: Additive.

| | |
|---|---|
| **First Layer: Antihalation Layer** | |
| Black colloidal silver | 0.15 (as silver) |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |
| **Second Layer: Low-Speed Red-Sensitive Emulsion Layer** | |
| Silver iodobromide emulsion (AgI: 4 mol %, uniform AgI type, diameter corresponding to sphere: 0.4 μm, coefficient of variation of diameter corresponding to sphere: 37%, tabular grain, diameter/thickness ratio: 3.0) | 0.4 (as silver) |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |

-continued

| | |
|---|---|
| ExC-2 | 0.03 |
| ExC-3 | 0.13 |
| **Third Layer: Medium-Speed Red-Sensitive Emulsion Layer** | |
| Silver iodobromide emulsion (AgI: 6 mol %, internal high AgI type, with core/shell ratio of 2/1, diameter corresponding to sphere: 0.65 μm, coefficient of variation of diameter corresponding to sphere: 25%, tabular grain, diameter/thickness ratio: 2.0) | 0.65 (as silver) |
| Silver iodobromide emulsion (AgI: 4 mol %, uniform AgI type, diameter corresponding to sphere: 0.4 μm, coefficient of variation of diameter corresponding to sphere: 37%, tabular grain, diameter/thickness ratio: 3.0) | 0.1 (as silver) |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-2 | 0.01 |
| ExC-3 | 0.06 |
| **Fourth Layer: High-Speed Red-sensitive Emulsion Layer** | |
| Silver iodobromide emulsion (AgI: 6 mol %, internal high AgI type, with core/shell ratio of 2/1, diameter corresponding to sphere: 0.7 μm, coefficient of variation of diameter corresponding to sphere: 25%, tabular grain, diameter/thickness ratio: 2.5) | 0.9 (as silver) |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |
| **Fifth Layer: Intermediate Layer** | |
| Gelatin | 0.6 |
| UV-4 | 0.03 |
| UV-5 | 0.04 |
| Cpd-1 | 0.1 |
| Polyethyl acrylate latex | 0.08 |
| Solv-1 | 0.05 |
| **Sixth Layer: Low-Speed Green-Sensitive Emulsion Layer** | |
| Silver iodobromide emulsion (AgI: 4 mol %, uniform AgI type, diameter corresponding to sphere: 0.4 μm, coefficient of variation of diameter corresponding to sphere: 37%, tabular grain, diameter/thickness ratio: 2.0) | 0.18 (as silver) |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |
| **Seventh Layer: Medium-Speed Green-Sensitive Emulsion Layer** | |
| Silver iodobromide emulsion (AgI: 4 mol %, surface high AgI type, with core/shell ratio of 1/1, diameter corresponding to sphere: 0.5 μm, coefficient of variation of diameter corresponding to sphere: 20%, tabular grain, diameter/thickness ratio: 4.0) | 0.27 (as silver) |
| Gelatin | 0.6 |
| ExS-3 | $2 \times 10^{-4}$ |
| ExS-4 | $7 \times 10^{-4}$ |

-continued

| | |
|---|---|
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| **Eighth Layer: High-Speed Green-Sensitive Emulsion Layer** | |
| Silver iodobromide emulsion (AgI: 8.7 mol %, multi-layer structure grain having silver amount ratio of 3/4/2, AgI content: 24 mol, 0 mol, 3 mol from inside, diameter corresponding to sphere: 0.7 μm, coefficient of variation of diameter corresponidng to sphere: 25%, tabular grain, diameter/thickness ratio: 1.6) | 0.7 (as silver) |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |
| **Ninth Layer: Intermediate Layer** | |
| Gelatin | 0.6 |
| Cpd-1 | 0.04 |
| Polyethyl acrylate latex | 0.12 |
| Solv-1 | 0.02 |
| **Tenth Layer: Donor Layer of Interimage Effect to Red-Sensitive Layer** | |
| Silver iodobromide emulsion (AgI: 6 mol %, internal high AgI type, with core/shell ratio of 2/1, diameter corresponding to sphere: 0.7 μm, coefficient of variation of diameter corresponding to sphere: 25%, tabular grain, diameter/thickness ratio: 2.0) | 0.68 (as silver) |
| Silver iodobromide emulsion (AgI: 4 mol %, uniform AgI type, diameter corresponding to sphere: 0.4 μm, coefficient of variation of diameter corresponding to sphere: 37%, tabular grain, diameter/thickness ratio: 3.0) | 0.19 (as silver) |
| Gelatin | 1.0 |
| ExS-3 | $6 \times 10^{-4}$ |
| ExM-10 | 0.19 |
| Solv-1 | 0.20 |
| **Eleventh Layer: Yellow Filter Layer** | |
| Yellow colloidal silver | 0.06 (as silver) |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| **Twelfth Layer: Low-Speed Blue-sensitive Emulsion Layer** | |
| Silver iodobromide emulsion (AgI: 4.5 mol %, uniform AgI type, diameter corresponding to sphere: 0.7 μm, coefficient of variation of diameter corresponding to sphere: 15%, tabular grain, diameter/thickness ratio: 7.0) | 0.3 (as silver) |
| Silver iodobromide emulsion (AgI: 3 mol %, uniform AgI type, diameter corresponding to sphere: 0.3 μm, coefficient of variation of diameter corresponding to sphere: 30%, tabular grain, diameter/thickness ratio: 7.0) | 0.15 (as silver) |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| **Thirteenth Layer: Intermediate Layer** | |
| Gelatin | 0.7 |
| ExY-12 | 0.20 |
| Solv-1 | 0.34 |
| **Fourteenth Layer: High-Speed Blue-sensitive Emulsion Layer** | |
| Silver iodobromide emulsion (AgI: 10 mol %, internal high AgI type, diameter corresponding to sphere: 1.0 μm, coefficient of variation of diameter corresponding to sphere: 25%, multiple twin tabular grain, diameter/thickness ratio: 2.0) | 0.5 (as silver) |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |
| **Fifteenth Layer: First Protective Layer** | |
| Fine grain silver iodobromide emulsion (AgI: 2 mol %, uniform AgI type, diameter corresponding to sphere: 0.07 μm) | 0.12 (as silver) |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethyl acrylate alatex | 0.09 |
| **Sixteenth Layer: Second Protective Layer** | |
| Fine grain silver iodobromide emulsion (AgI: 2 mol %, uniform AgI type, diameter corresponding to sphere: 0.07 μm) | 0.36 (as silver) |
| Gelatin | 0.55 |
| Polymethyl methacrylate particle (diameter: 1.5 μm) | 0.2 |
| H-1 | 0.17 |

Each layer described above contained a stabilizer for emulsion (Cpd-3: 0.07 g/m$^2$) and a surface active agent (Cpd-4: 0.03 g/m$^2$) as a coating aid in addition to the above-described components.

The components used for the preparation of the light-sensitive material are illustrated below.

UV-1

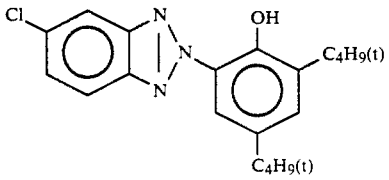

UV-2

-continued
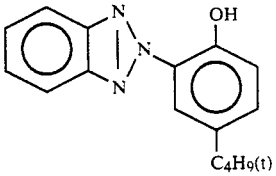
UV-3
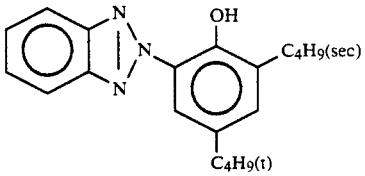
UV-4
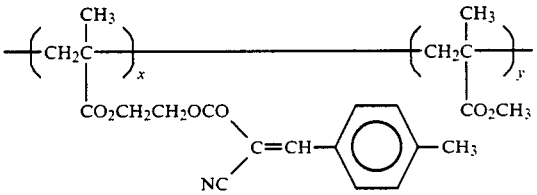
x/y = 70/30 (wt %)
UV-5
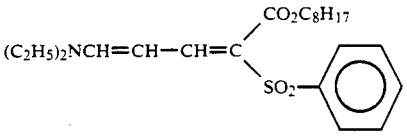
Solv-1 Tricresyl phosphate
Solv-2 Dibutyl phthalate
Solv-4
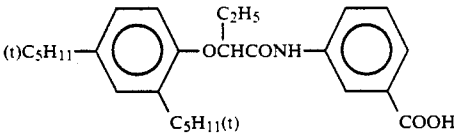
Solv-5 Trihexyl phosphate
ExF-1
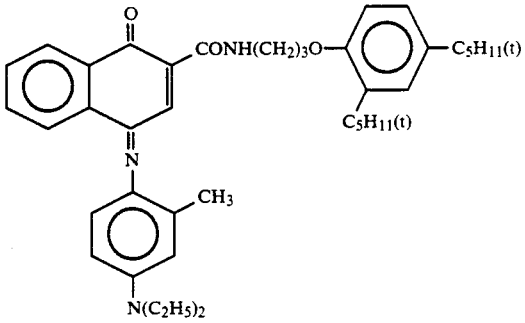
ExF-2

-continued
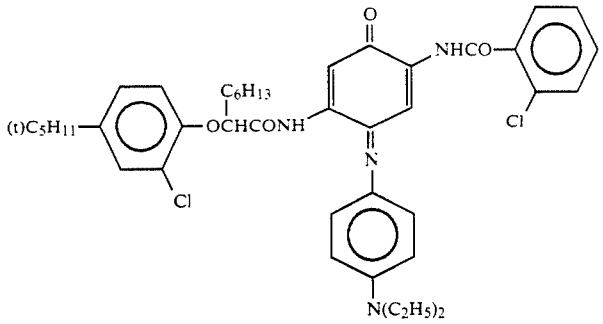
ExS-1
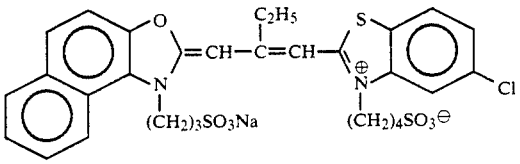
ExS-2
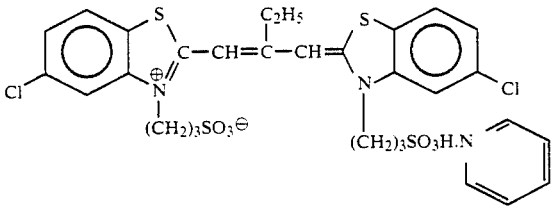
ExS-3
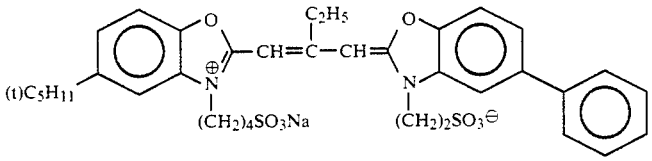
ExS-4
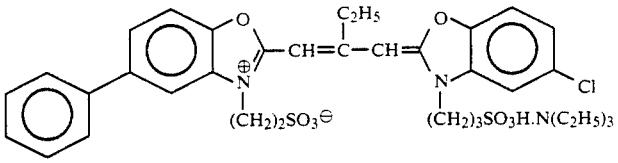
ExS-5
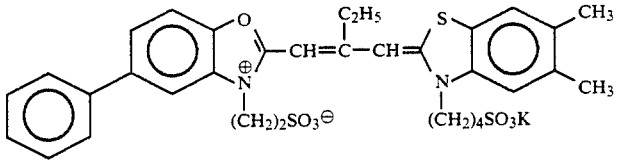
ExS-6
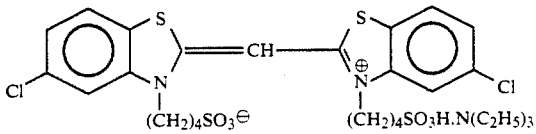
ExS-7

-continued
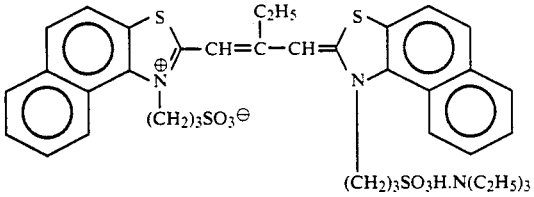
ExS-8
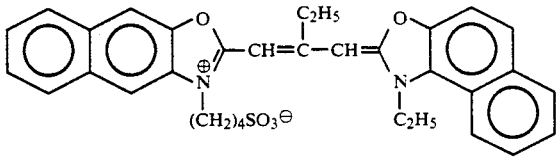
ExC-1
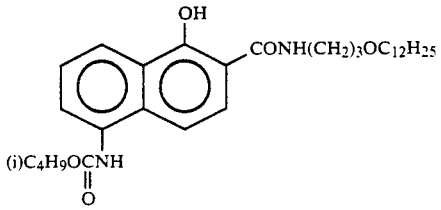
ExC-2
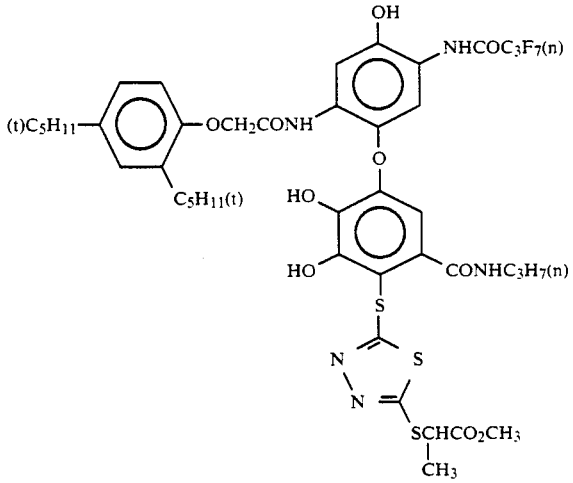
ExC-3
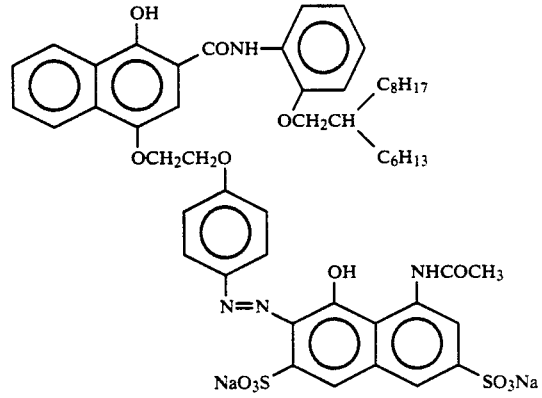
ExC-4

-continued
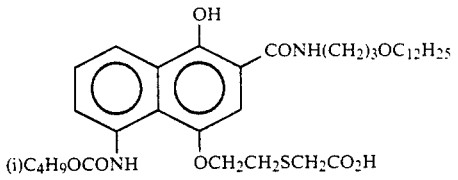
ExM-5
p. 154
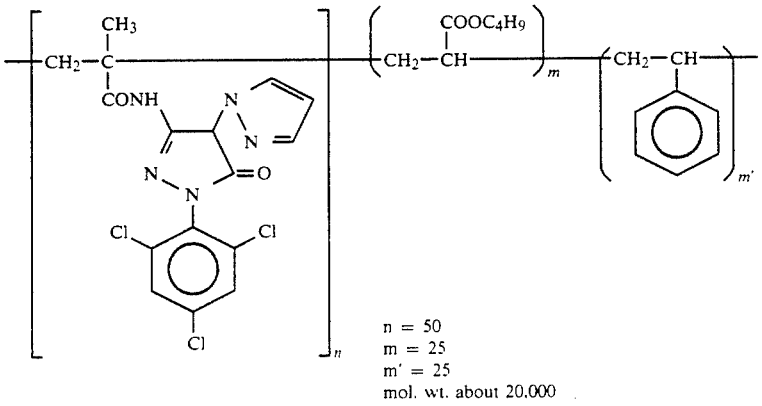
ExM-6
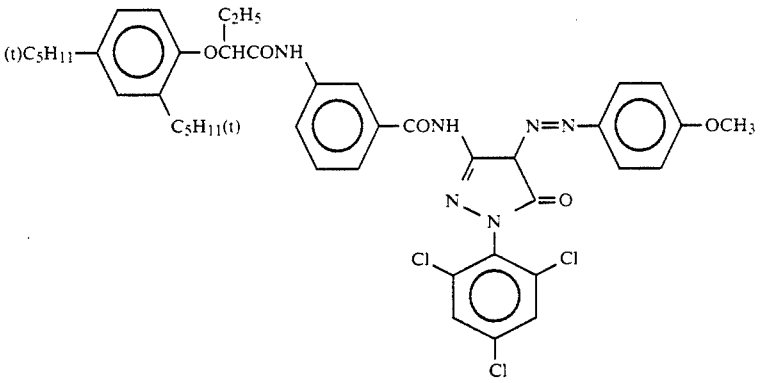
ExM-7
p. 155
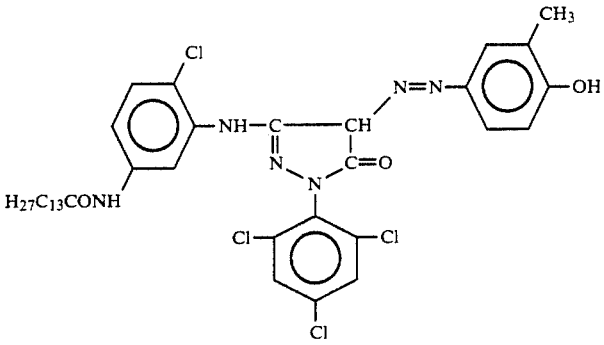
ExM-10

-continued
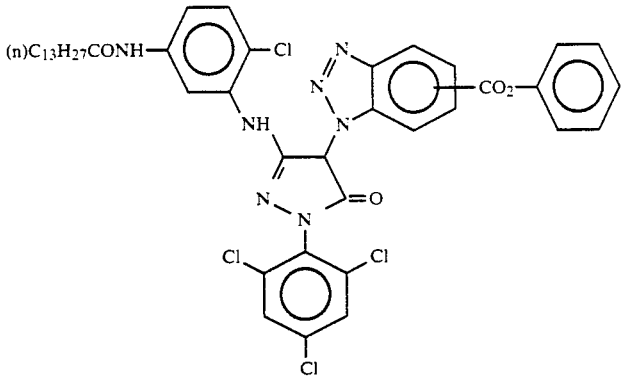
ExY-8
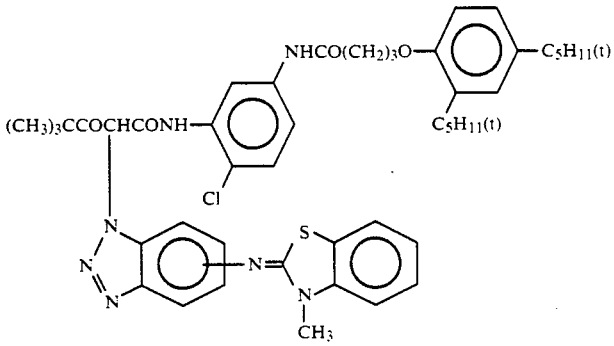
ExY-9
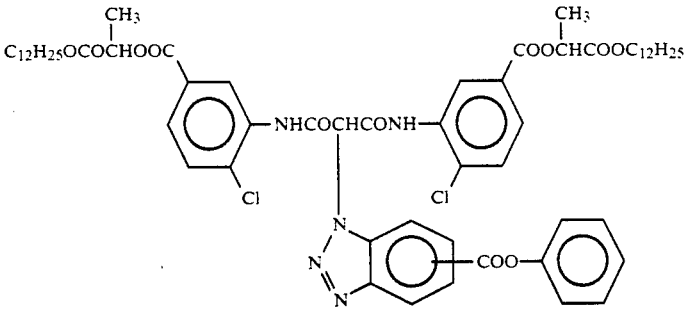
ExY-11
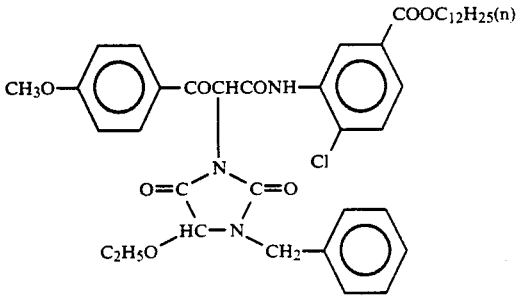
ExY-12

-continued
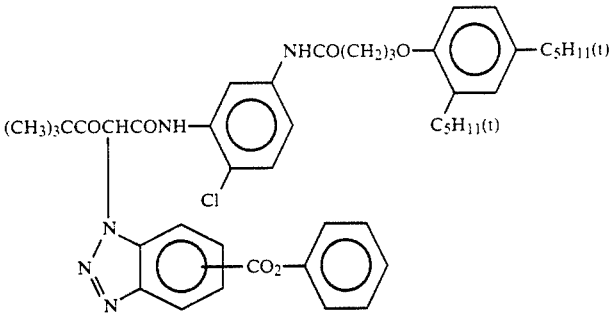
Cpd-7
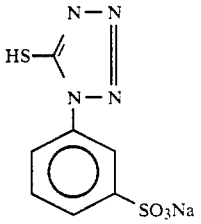
Cpd-1
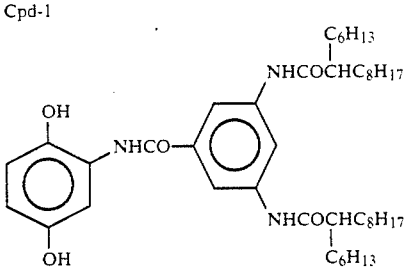
Cpd-2
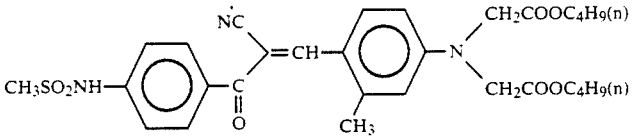
Cpd-6
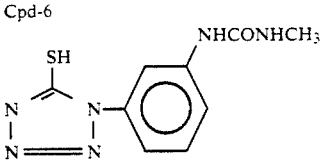
Cpd-5
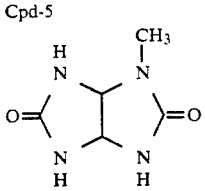
Cpd-3
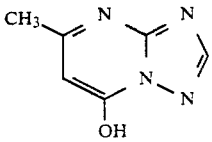
Cpd-4

-continued
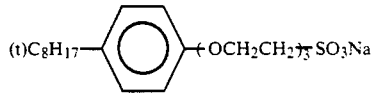
H-1
$CH_2{=}CH{-}SO_2{-}CH_2{-}CONH{-}CH_2$
$\quad\quad\quad

| Processing Step | Processing Temperature (°C.) | Processing Time | Amount of Replenishment* (ml) | Capacity of Tank (l) |
|---|---|---|---|---|
| Processing Step (V): | | | | |
| Color Development | 37.8 | 3 min. 15 sec. | 21 | 5 |
| Bleaching | 3.80 | 45 sec. | 45 | 2 |
| Fixing (1) | 38.0 | 45 sec. | Two-tank countercurrent system | 2 |
| Fixing (2) | 38.0 | 45 sec. | 30 | 2 |
| Stabilizing (1) | 38.0 | 20 sec. | Three-tank countercurrent system | 1 |
| Stabilizing (2) | 38.0 | 20 sec. | 35 | 1 |
| Stabilizing (3) | 38.0 | 20 sec. | | 1 |
| Drying | 55 | 1 min. 00 sec. | | |

*Amount of replenishment per 1 meter of 35 m/m width strip

In the fixing tank of the automatic developing machine used, a jet stirrer described in JP-A-62-183460, page 3 was equipped, and the light-sensitive material was processed in a manner such that the jet of the fixing solution struck the surface of the light-sensitive material.

The composition of each processing solution used is illustrated below.

| | Mother Liquor | Replenisher |
|---|---|---|
| Color Developing Solution: | | |
| Hydroxyethyliminodiacetic Acid | 5.0 g | 6.0 g |
| Sodium Sulfite | 4.0 g | 5.0 g |
| Potassium Carbonate | 30.0 g | 37.0 g |
| Potassium Bromide | 1.3 g | 0.5 g |
| Potassium Iodide | 1.2 mg | — |
| Hydroxylamine Sulfate | 2.0 g | 3.6 g |
| 4-[N-Ethyl-N-β-hydroxyethyl-amino]-2-methylaniline Sulfate | $1.0 \times 10^{-2}$ mol | $1.3 \times 10^{-2}$ mol |
| Water to make | 1.0 l | 1.0 l |
| pH | 10.00 | 10.15 |
| Bleaching Solution: | | |
| Ferric Complex Salt of 1,3-Diaminopropanetetraacetic Acid | 130 g | 190 g |
| 1,3-Diaminopropanetetraacetic Acid | 3.0 g | 4.0 g |
| Ammonium Bromide | 85 g | 120 g |
| Acetic Acid | 50 g | 70 g |
| Ammonium Nitrate | 30 g | 40 g |
| Water to make | 1.0 l | 1.0 l |
| pH | 4.3 | 3.5 |

The pH was adjusted with acidic acid and aqueous ammonia.

| Fixing Solution: | Mother Liquor | Replenisher |
|---|---|---|
| 1-Hydroxyethylidene-1,1-diphosphonic Acid | 5.0 g | 7.0 g |
| Disodium Ethylenediaminetetraacetate | 0.5 g | 0.7 g |
| Sodium Sulfite | 10.0 g | 12.0 g |
| Sodium Bisulfite | 8.0 g | 10.0 g |
| Aqueous Solution of Ammonium Thiosulfate (700 g/l) | 170.0 ml | 200.0 ml |
| Ammonium Thiocyanate | 100.0 g | 150.0 g |
| Thiourea | 3.0 g | 5.0 g |
| 3,6-Dithia-1,8-octanediol | 3.0 g | 5.0 g |
| Water to make | 1.0 l | 1.0 l |
| pH | 6.5 | 6.7 |

The pH was adjusted with acetic acid and aqueous ammonia.

| Stabilizing Solution: (both Mother Liquor and Replenisher) | |
|---|---|
| Formaline (37 wt %) | 1.2 ml |
| 5-Chloro-2-methyl-4-isothiazolin-3-one | 6.0 mg |
| 2-Methyl-4-isothiazolin-3-one | 3.0 mg |
| Surface Active Agent $C_{10}H_{21}—O—(CH_2CH_2O)_{10}H$ | 0.4 g |
| Ethylene Glycol | 1.0 g |
| Water to make | 1.0 l |
| pH | 5.0 to 7.0 |

TABLE 3

| Sample No. | Compound Added to Fourth Layer | Amount of Remaining Silver: Processing Step (IV) (mg/m²) | Amount of Remaining Silver: Processing Step (V) (mg/m²) | Sensitivity of* Red-Sensitive Layer (Processing Step (V)) |
|---|---|---|---|---|
| 301 | ExC-4 | 78 | 68 | ±0 |
| 302 | A | 63 | 57 | +0.01 |
| 303 | B | 37 | 55 | −0.05 |
| 304 | C | 74 | 64 | +0.02 |
| 305 | ExC-4, D | 76 | 63 | −0.01 |
| 306 | ExC-4, E | 17 | 24 | −1.25 |
| 307 | ExC-4, F | 10 | 11 | −0.26 |
| 308 | ExC-4, (I-1) | 13 | 14 | +0.01 |
| 309 | ExC-4, (I-2) | 17 | 15 | −0.01 |
| 310 | ExC-4, (I-6) | 25 | 22 | ±0 |
| 311 | ExC-4, (I-7) | 24 | 23 | −0.01 |
| 312 | ExC-4, (I-8) | 13 | 16 | +0.01 |
| 313 | ExC-4, (I-20) | 10 | 15 | ±0 |
| 314 | ExC-4, (I-24) | 27 | 29 | ±0 |

*Log E value at a point having a density of fog + 0.2 using Sample 301 as standard.

The sensitivities of red-sensitive layer of the samples obtained from Processing Step (IV) were almost the same as those obtained from Processing Step (V), respectively.

As is apparent from the results shown in Table 3 above, the samples of the present invention also exhibit a sufficiently high desilvering effect in Example 3.

Specifically, the amount of the remaining silver can be reduced to 1/7 to ⅛ in the sample of the present invention compared with Sample 301 which does not contain a bleach accelerating agent when the desilvering process extends for 4 min. 15 sec. in Processing Step (IV). In Samples 303, 306 and 307, the sensitivity of the red-sensitive layer is remarkably decreased, although the amount of remaining silver can be reduced. Further, similar results are obtained in case of Processing Step (V) when the desilvering process is conducted for 2 min. 15 sec.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, wherein the silver halide color photographic material contains at least one compound represented by formula (I) in the silver halide emulsion layer or in a light-insensitive hydrophilic colloid layer:

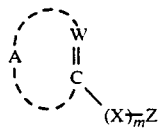

(I)

wherein

X represents a divalent linking group connected to the carbon atom through a hetero atom in X;

Z represents a bleach accelerating agent moiety connected to X through a hetero atom in Z;

W represents =N—or

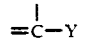

(wherein Y represents a hydrogen atom or another substituent),

A represents an atomic group necessary to form an aromatic heterocyclic ring selected from the group consisting of a triazaindene, a tetraazaindene and a pentaazaindene wherein said triazaindene, tetraazaindene or pentaazaindene is a 6-membered aromatic ring fused to a five-membered aromatic ring; and m represents 0 to 1, provided that when m represents 0, the bleach accelerating agent moiety represented by Z is connected to the carbon atom through a hetero atom in Z.

2. The silver halide color photographic material as claimed in claim 1, wherein Y represents a hydrogen atom, a halogen atom, an alkyl group, an aryl group, an alkoxy group, an aryloxy group, an acyloxy group, an amino group, a carbonamido group, a ureido group, a carboxy group, a carbonic acid ester group, an oxycarbonyl group, a carbamoyl group, an acyl group, a sulfo group, a sulfonyl group, a sulfamoyl group, a cyano group or a nitro group.

3. The silver halide color photographic material as claimed in claim 1, wherein the bleach accelerating agent moiety represented by Z is a group represented by formula (Z-1), (Z-2), (Z-3), (Z-4) or (Z-5):

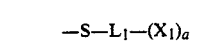

$$-S-L_1-(X_1)_a \qquad \text{(Z-1)}$$

wherein a represents an integer of from 1 to 4; $L_1$ represents a straight chain or branched chain alkylene group having a valency of (a+1) and having from 1 to 8 carbon atoms, provided that a cycloalkylene is excluded; $X_1$ represents a hydroxy group, a carboxyl group, a cyano group, an amino group having from 0 to 10 carbon atoms, an acyl group having from 1 to 10 carbon atoms, a heterocyclic thio group having from 1 to 10 carbon atoms, a carbamoyl group having from 1 to 10 carbon atoms, a sulfonyl group having from 1 to 10 carbon atoms, a heterocyclic group having from 1 to 10 carbon atoms, a sulfamoyl group having from 0 to 10 carbon atoms, a carbonamido group having from 1 to 10 carbon atoms, an ammoniumyl group having from 3 to 12 carbon atoms, a ureido group having from 1 to 10 carbon atoms, a sulfamoylamino group having from 0 to 10 carbon atoms, an alkoxy group having from 1 to 6 carbon atoms, an amidino group, a guanidino group, and an amidinothio group, provided that when a is greater than 1, the $X_1$ groups may be the same or different;

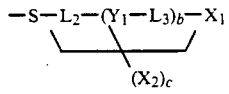

$$-S-L_2-(Y_1-L_3)_b-X_1 \qquad \text{(Z-2)}$$

$$(X_2)_c$$

wherein b represents an integer of from 1 to 6; c represents an integer of from 0 to 7; $L_2$ and $L_3$ each represents a straight chain or branched chain alkylene group having from 1 to 3 carbon atoms; $X_1$ and $X_2$ each has the same meaning as $X_1$ defined in the formula (Z-1); and $Y_1$ represents

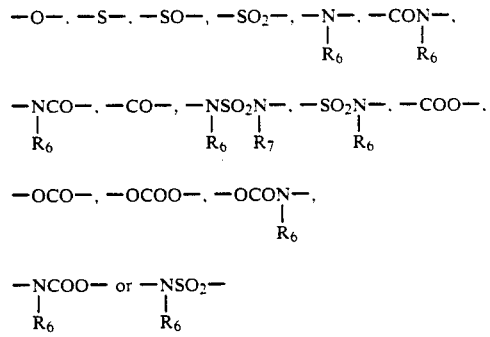

(wherein $R_6$ and $R_7$ each represents a hydrogen atom or an alkyl group having from 1 to 10 carbon atoms, provided that when b is greater than 1, the $Y_1$—$L_3$ groups may be the same or different, with the proviso that all $Y_1$ groups are not —S—at the same time, and when c is an integer other than 0, $X_2$ may be substituted on any of the $L_2$, $Y_1$ and $L_3$ groups;

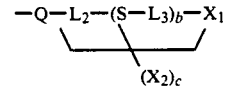

$$-Q-L_2-(S-L_3)_b-X_1 \qquad \text{(Z-3)}$$

$$(X_2)_c$$

wherein b, c, $L_2$, $L_3$, $X_1$ and $X_2$ each has the same meaning as in the formula (Z-2); and Q represents —O—, —S—, —OCO—, —$OSO_2$—, —OSO—,

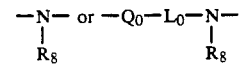

(wherein $R_8$ has the same meaning as $R_6$ defined in the formula (Z-2); $L_0$ has the same meaning as $L_2$ defined above; and $Q_0$ represents —O—, —OCO—, —$OSO_2$—, —OSO—or $-\underset{\underset{R_8}{|}}{N}-).$ provided that when b is greater than 1, the S-$L_3$ groups may be the same or different, and when c is an integer other than 0, $X_2$ may be substituted on any of the Q, $L_2$ and $L_3$ groups, and with the further proviso that when Q is —S—, b is not 1;

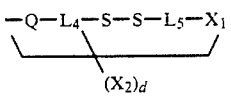

(Z-4)

wherein Q, $X_1$ and $X_2$ each has the same meaning as in the formula (Z-3); d represents an integer of from 0 to 6; and $L_4$ and $L_5$ each represents a linking group having from 1 to 16 carbon atoms in total, provided that when d is an integer other than 0, $X_2$ may be substituted on any of the Q, $L_4$ and $L_5$ groups; and $-S-L_6-(X_3)_e$ (Z-5)

wherein $L_6$ represents a cycloalkylene group having from 3 to 12 carbon atoms, an arylene group having from 6 to 10 carbon atoms, an unsaturated heterocyclic group having from 1 to 10 carbon atoms, or a saturated or partially saturated heterocyclic group having from 2 to 10 carbon atoms; $X_3$ represents a hydrophilic substituent; and e represents an integer of from 0 to 5.

4. The silver halide color photographic material as claimed in claim 1, wherein the moiety of X-Z is represented by any of the following formulae:

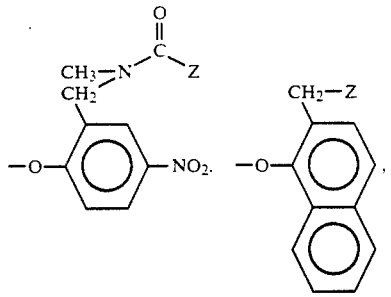

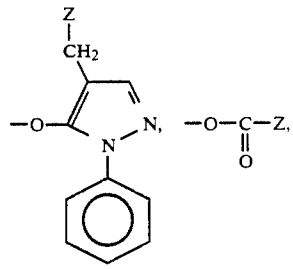

$-OCH_2-Z$, $-O-\underset{\underset{O}{\|}}{C}-OCH_2-Z$.

-continued

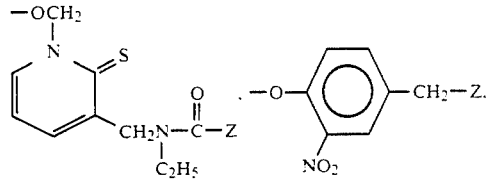

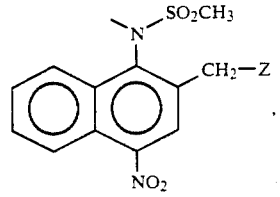

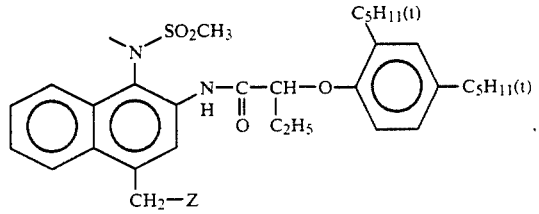

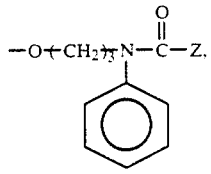

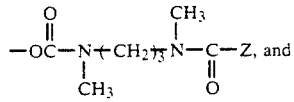

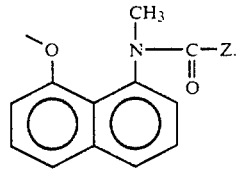

5. The silver halide color photographic material as claimed in claim 1, wherein the compound represented by formula (I) is present in a light-insensitive hydrophilic colloid layer.

6. The silver halide color photographic material as claimed in claim 1, wherein an amount of the compound represented by formula (I) is from 0.01 mol% to 100mol% based on the total coating amount of silver.

7. The silver halide color photographic material as claimed in claim 1, wherein the bleach accelerating agent moiety represented by Z in a group represented by formula (Z-1):

$-S-L_1-(X_1)_a$ (Z-1)

wherein a represents an integer of from 1 to 4; $L_1$ represents a straight chain or branched chain alkylene group having a valence of (a+1) and having from 1 to 8 carbon atoms, provided that a cycloalkylene is excluded; $X_1$ represents a hydroxy group, a carboxyl group, a cyano group, an amino group having from 0 to 10 carbon atoms, an acyl group having from 1 to 10 carbon atoms, a heterocyclic thio group having from 1 to 10 carbon atoms, a carbamoyl group having from 1 to 10 carbon atoms, a sulfonyl group having from 1 to 10 carbon atoms, a heterocyclic group having from 1 to 10 carbon atoms, a sulfamoyl group having from 0 to 10 carbon atoms, a carbonamido group having from 1 to 10 carbon atoms, an ammoniumyl group having from 3 to 12 carbon atoms, a ureido group having from 1 to 10 carbon atoms, a sulfamoylamino group having 0 to 10 carbon atoms, an alkoxy group having from 1 to 6 carbon atoms, an amidino group, a guanidino group, and an amidinothio group, provided that when a is greater than 1, the $X_1$ groups may be the same or different.

8. The silver halide color photographic material as claimed in claim 1, wherein the silver halide emulsion layer contains silver iodobromide having from about 2 mol% to about 25 mol% of silver iodide.

9. The silver halide color photographic material as claimed in claim 1, wherein said aromatic heterocyclic ring is a tetraazaindene or a pentaazindene.

10. The silver halide color photographic material as claimed in claim 1, wherein said aromatic heterocyclic ring is an imidazo pyrimidine, a 1H-imidazo pyridine, a pyrazolo pyrimidine or a 7H-pyrrolo pyrimidine.

11. The silver halide color photographic material as claimed in claim 1, wherein said aromatic heterocyclic ring is a 1H-1,2,4-triazolo pyridazine, an imidazo -1,3,5-triazine, a 1H-pyrazolo -pyrimidine, a 1,2,4-triazolo pyrimidine, pyrazolo -1,3,5-triazine, a 7H-purine or a 9H-purine.

12. The silver halide color photographic material as claimed in claim 1, wherein said aromatic heterocyclic ring is a 1,2,4-triazolo -1,3,5-triazine, a 1,2,4-triazolo -1,2,4-triazine or a 1H-1,2,3-triazolo pyrimidine.

13. The silver halide color photographic material as claimed in claim 1, wherein said aromatic heterocyclic ring is a 1,2,4-triazolo pyrimidine.

* * * * *